US005773185A

United States Patent [19]

Yachi et al.

[11] Patent Number: 5,773,185

[45] Date of Patent: Jun. 30, 1998

[54] TONER FOR DEVELOPING ELECTROSTATIC IMAGES, AND PROCESS FOR PRODUCING THE SAME

[75] Inventors: Shinya Yachi; Koji Inaba, both of Yokohama; Kazunori Kato, Mitaka, all of Japan

[73] Assignee: Canon Kabushiki Kaisha, Tokyo, Japan

[21] Appl. No.: 911,751

[22] Filed: Aug. 15, 1997

Related U.S. Application Data

[62] Division of Ser. No. 655,605, May 30, 1996, Pat. No. 5,679,490.

[30] Foreign Application Priority Data

May 31, 1995 [JP] Japan ..... 7-156772

[51] Int. Cl.[6] ..... G03G 9/093; G03G 9/097

[52] U.S. Cl. ..... 430/137

[58] Field of Search ..... 430/137

[56] References Cited

U.S. PATENT DOCUMENTS

| | | | |
|---|---|---|---|
| 2,297,691 | 10/1942 | Carlson | 430/31 |
| 3,666,363 | 5/1972 | Tanaka et al. | 430/55 |
| 4,071,361 | 1/1978 | Marushima | 430/55 |
| 5,510,222 | 4/1996 | Inaba et al. | 430/109 |
| 5,529,873 | 6/1996 | Chiba et al. | 430/109 |

FOREIGN PATENT DOCUMENTS

| | | |
|---|---|---|
| 36-10231 | 2/1961 | Japan . |
| 42-10799 | 6/1967 | Japan . |
| 42-23910 | 11/1967 | Japan . |
| 43-24748 | 10/1968 | Japan . |
| 58-57105 | 12/1983 | Japan . |
| 59-53856 | 3/1984 | Japan . |
| 59-61842 | 4/1984 | Japan . |
| 60-238846 | 11/1985 | Japan . |
| 61-35457 | 2/1986 | Japan . |
| 61-273558 | 12/1986 | Japan . |
| 62-73277 | 4/1987 | Japan . |
| 64-62666 | 3/1989 | Japan . |
| 64-63035 | 3/1989 | Japan . |
| 1-230073 | 9/1989 | Japan . |
| 3-35660 | 2/1991 | Japan . |
| 5-134437 | 5/1993 | Japan . |
| 5-197203 | 8/1993 | Japan . |
| 6-317925 | 11/1994 | Japan . |

*Primary Examiner*—Roland Martin

*Attorney, Agent, or Firm*—Fitzpatrick, Cella, Harper &Scinto

[57] ABSTRACT

A toner which comprises toner particles containing a binder resin, a colorant, a polar resin and a release agent, wherein the binder resin is a styrene polymer, a styrene copolymer, or a mixture of these, and has a weight average molecular weight $Mw_1$ of from 10,000 to 1,000,000, the polar resin is a polyester resin containing a tetrahydrofuran-soluble matter of which weight average molecular weight $Mw_2$ is from 7,000 to 50,000 and an ethyl alcohol-soluble matter of which weight average molecular weight $Mw_3$ is from 1,000 to 7,000, where $Mw_2/Mw_3$ is from 1.2 to 10.

36 Claims, 4 Drawing Sheets

TONER FOR DEVELOPING ELECTROSTATIC IMAGES, AND PROCESS FOR PRODUCING THE SAME

This application is a division of application Ser. No. 08/655,605 filed May 30, 1996, now U.S. Pat. No. 5,679,490.

BACKGROUND OF THE INVENTION

1. Field of the invention

This invention relates to a toner for developing electrostatic latent images, used in an image forming process such as electrophotography or electrostatic printing, and a process for producing the toner.

2. Related Background Art

A number of methods as disclosed in U.S. Pat. No. 2,297,691, Japanese Patent Publication No. 42-23910 and No. 43-24748 and so forth are conventionally known as electrophotography. In general, copied images or print images are obtained by forming an electrostatic image on a photosensitive member by utilizing a photoconductive material, subsequently developing the electrostatic latent image by the use of a toner to form a toner image, and transferring the toner image to a transfer medium such as paper if necessary, followed by fixing by the action of heat, pressure, heat-and-pressure, or solvent vapor.

A variety of methods for developing electrostatic images by the use of toners or methods for fixing toner images, have been proposed, from which methods suited for the intended image forming processes are employed. Conventionally, it is common to produce toners used for such purpose by melt-kneading colorants comprised of dyes and/or pigments into thermoplastic resins for uniformly dispersion, followed by pulverization and classification to obtain a toner of desired particle diameter.

Reasonably good toners can be produced by such a production method, but there is a certain limit. For example, the resin composition in which the colorant is dispersed must be brittle enough to be pulverizable by means of economically available production apparatus. However, such a resin composition tends to result in particles of a broad particle size range when actually pulverized at a high speed, especially causing a problem that relatively large particles are present in the particles.

Moreover, such highly brittle materials tend to be further crushed or powdered when used in development. By this method, also, uniform and fine dispersion of solid fine particles of colorants or the like in the resin is difficult to achieve, and increase of fogging, decrease of image density, or lowering of color mixing properties or transparency of the toner may occur depending on the degree of dispersion. Colorants exposed on the rupture sections of toner particles may cause fluctuations in developing performance of the toner.

Meanwhile, in order to overcome the problems of the toners produced by such pulverization, methods of producing toners by suspension polymerization are proposed in Japanese Patent Publication No. 36-10231, No. 42-10799 and No. 51-14895. In the suspension polymerization, polymerizable monomers, a colorant and a polymerization initiator, and also optionally a cross-linking agent, a charge control agent and other additives are uniformly dissolved or dispersed to form a monomer composition, and this monomer composition is dispersed in an aqueous medium containing a dispersion stabilizer, followed by polymerization of the polymerizable monomers to obtain toner particles having the desired particle diameters.

Since this method has no pulverization step, brittleness is not required and soft materials can be used. Also, the colorant does not come bare to the surfaces of toner particles, and hence the toner particles can have a uniform triboelectric charging performance. Also, since it is possible to omit the classification step, this method is greatly effective for cost reduction on account of energy saving, reduction of production time, improvements in process yield and so forth.

However, even when such a method is used, when the toner particle size is made finer the colorant easily come to surface of toner particles to affect the toner performance. As a result, uniform chargeability may be lowered, causing fluctuation in developing performance of the toner.

This phenomenon is conspicuous especially when copying or printing is continued in an environment of high humidity. In order to achieve uniform charging, as disclosed in Japanese Patent Application Laid-open No. 62-73277 and No. 3-35660, a method has been proposed in which the surface layers of toner particles are coated with resin.

In this method, however, the coat layers have a large thickness. Hence, although the performances can be prevented from being affected by colorants, the toner can little contain components having charge controllability, so that the absolute value of charge quantity becomes small. Such a problem has been seen. To cope with this problem, as disclosed in Japanese Patent Application Laid-open No. 64-62666 and No.64-63035 and Japanese Patent Publication No. 58-57105, a method is proposed in which the surfaces of toner particles are further coated in multi-layers. This, however, makes production steps complicated, resulting in cost disadvantage. In order to settle such a problem, as disclosed in Japanese Patent Application Laid-open No. 61-273558 and No. 5-134437, a method is proposed in which a charge control agent is deposited on the surfaces of toner particles. In this method, however, taking account of the durability of toner that is required when copying or printing is repeated, the charge control agent may release from the surfaces of toner particles to cause a problem on running performance.

It is also proposed, as disclosed in Japanese Patent Application Laid-open No. 60-238846 and No. 5-197203, to use a toner for developing electrostatic images which comprises toner particles produced by suspension polymerization where a polymerizable monomer composition containing a polyester resin is dispersed in an aqueous medium to carry out granulation. However, it is expected to provide a toner for developing electrostatic images that has much superior triboelectric charging performance, multiple-sheet running performance, high-temperature anti-offset properties and light transmission properties.

In recent years, digital full-color copying machines and printers are commercially available and it has become possible to achieve a image quality high to be superior not only in resolution and gradation but also in color reproducibility free of uneven color.

In such digital full-color copying machines and printers, a colored original image is color-separated using B (blue), G (green) and R (red) filters, and thereafter an electrostatic image formed of dots with diameters of from 20 to 70 $\mu$m corresponding to an original image is developed by utilizing the action of subtractive color mixing making use of Y (yellow), M (magenta), C (cyan) and Bk (black) color toners. Compared with black-and-white copying machines, a larger quantity of toner must be transferred from the photosensitive member to the transfer medium, and the toner particles need to have smaller particle diameters corresponding to the fine dots so as to meet the requirement for higher image quality.

With coming high speed processing and full color-printing by printers and copying machines, the improvement of low-temperature fixing performance becomes an important factor. From such a point of view, toners obtained by the polymerization method are preferred, which can relatively readily obtain toner particles having a sharp particle size distribution and very small particle diameters. Toners used in full-color copying machines or full-color printers are required for the respective color toners to well undergo color mix in the fixing step, and hence it is important to improve color reproducibility or to assure a transparency of overhead projector (hereinafter "OHP") images. Also, it is preferable for the color toners to be formed of resins having better melt properties and lower molecular weight than black toners.

As release agents for black toners, waxes having a relatively high crystallizability as typified by polyethylene wax and polypropylene wax are used for the purpose of improving high-temperature anti-offset properties at the time of fixing. However, in the color toners for full-color reproduction, images show a low transparency when output through an OHP, because of the high crystallizability of the waxes.

Accordingly, as a component of color toners, an anti-offset fluid such as silicone oil is usually applied to the heat fixing roller without addition of the release agent so that the high-temperature anti-offset properties can be improved.

In that case, superfluous silicone oil adheres to the surface of the transfer medium after fixing, and this is not preferable since some users may feel disagreeable when they touch it.

For this reason, studies have been done on toners for oil-less fixing which are comprised of toner particles internally incorporated with a low-softening point substance in a large quantity, but it is further sought to provide toners having much superior low-temperature fixing performance and transparency and at the same time showing a high-temperature anti-offset properties.

As a means for solving such various problems, Japanese Patent Application Laid-open No. 1-230073 discloses a color image fixing method making use of a polymerization toner containing a low-softening point substance having release properties. The toner tends to cause a lowering of developing performance during running which is considered due to the exudation of the low-softening point substance to the surfaces of toner particles.

For the purpose of preventing colorants from coming bare to the surfaces of toner particles or the low-softening point substance from exuding, it is proposed to add a polar polymer or a polar copolymer in the polymerizable monomer composition, as disclosed in Japanese Patent Application Laid-open No. 61-35457, and also to provide a hydrophilic shell material on the surfaces of toner particles, as disclosed in Japanese Patent Application Laid-open No. 6-317925.

Even with employment of such methods, however, the toner has a poor developing performance in an environment of high humidity, resulting in a poor running performance, because the material that forms shells are hydrophilic. Moreover, since the glass transition point of the core resin is set to 10° to 50° C. in order to prevent any fixing inhibition due to the shell material, the transfer medium tends to wind around the fixing roller at the time of fixing.

Accordingly, in the toners produced by polymerization, in particular, color toners, it is sought to provide a toner that has well solved the problems caused in regard to both the developing performance and the fixing performance.

SUMMARY OF THE INVENTION

An object of the present invention is to provide a toner for developing electrostatic images that has solved the problems as discussed above, and a process for producing such a toner.

Another object of the present invention is to provide a toner for developing electrostatic images that has superior triboelectric charging performance and multiple-sheet running performance, and a process for producing such a toner.

Still another object of the present invention is to provide a toner for developing electrostatic images that has superior low-temperature fixing performance and high-temperature anti-offset properties, and a process for producing such a toner.

A further object of the present invention is to provide a toner for developing electrostatic images that has a superior fluidity, which can obtain images having a high image density and a good fine-line reproduction and highlight reproduction, and a process for producing such a toner.

The present invention provides a toner for developing electrostatic images, comprising toner particles, wherein;

the toner particles contain a binder resin, a colorant, a polar resin and a release agent;

the binder resin is a styrene polymer, a styrene copolymer, or a mixture of these, and has a weight average molecular weight ($Mw_1$) of from 10,000 to 1,000,000;

the polar resin is a polyester resin; the polyester resin containing a tetrahydrofuran(THF)-soluble matter having a weight average molecular weight ($Mw_2$) of from 7,000 to 50,000 and an ethyl alcohol-soluble matter having a weight average molecular weight ($Mw_3$) of from 1,000 to 7,000; $Mw_2/Mw_3$ being from 1.2 to 10.

The present invention also provides a process for producing a toner, comprising the steps of;

preparing a polymerizable monomer composition containing at least styrene-containing polymerizable monomers, a colorant, a polyester resin, a release agent and a polymerization initiator; the polyester resin containing a tetrahydrofuran(THF)-soluble matter having a weight average molecular weight ($Mw_2$) of from 7,000 to 50,000 and an ethyl alcohol-soluble matter having a weight average molecular weight ($Mw_3$) of from 1,000 to 7,000; $Mw_2/Mw_3$ being from 1.2 to 10;

dispersing the polymerizable monomer composition in an aqueous medium to form granules of the polymerizable monomer composition;

causing the polyester resin to localize on the surfaces of the granules of the polymerizable monomer composition;

polymerizing the polymerizable monomers present in the granules to form a binder resin for toner particles; the binder resin being a styrene polymer, a styrene copolymer, or a mixture of these, and having a weight average molecular weight ($Mw_1$) of from 10,000 to 1,000,000; and adding a water-soluble polymerization initiator in the aqueous medium to modify the surfaces of the toner particles.

DESCRIPTION OF THE PREFERRED EMBODIMENTS

The toner particles that constitute the toner of the present invention contain a binder resin, a colorant, a polar resin and a release agent; the binder resin is a styrene polymer, a styrene copolymer, or a mixture of these, and has a weight average molecular weight ($Mw_1$) of from 10,000 to 1,000,000; the polar resin is a polyester resin, where the polyester resin contains a tetrahydrofuran(THF)-soluble matter having a weight average molecular weight ($Mw_2$) of from 7,000 to 50,000 and an ethyl alcohol-soluble matter having a weight average molecular weight ($Mw_3$) of from 1,000 to 7,000, and $Mw_2/Mw_3$ is from 1.2 to 10, and preferably from 2 to 8. This achieves an improvement in low-temperature fixing performance of the toner, an improvement in its high-temperature anti-offset properties and an improvement in its triboelectric charging performance.

Figure 2:
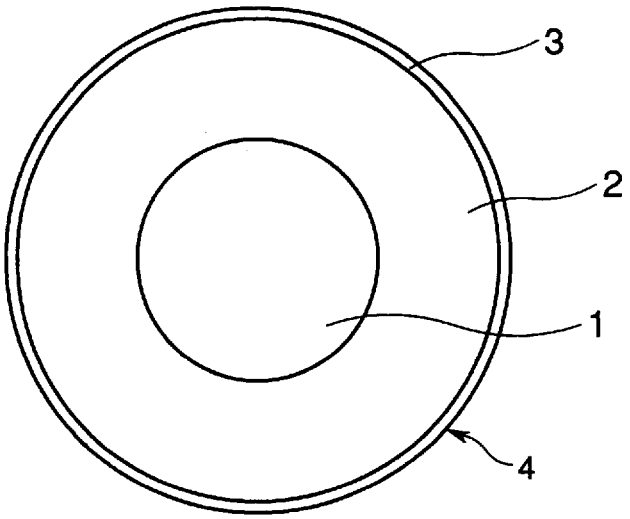
FIG. 2 diagrammatically illustrates a cross section of a toner particle.

The toner particles may preferably have a particle structure as shown in FIG. 2, where the release agent 1 is encapsulated with a binder resin layer 2, a polyester resin layer 3 is present on it, and the modified surface 4 is further provided outermost by treating with a water-soluble polymerization initiator. This enables more improvement in negative triboelectric charging performance of the toner, its multiple-sheet running performance, mechanical strength of toner particles, blocking resistance and fluidity while maintaining good low-temperature fixing performance and high-temperature anti-offset properties.

The toner particles that constitute the toner of the present invention can be produced in a good yield by;

preparing a polymerizable monomer composition containing at least styrene-containing polymerizable monomers, a colorant, a polyester resin, a release agent and a polymerization initiator, where the polyester resin contains a tetrahydrofuran(THF)-soluble matter having a weight average molecular weight ($Mw_2$) of from 7,000 to 50,000 and an ethyl alcohol-soluble matter having a weight average molecular weight ($Mw_3$) of from 1,000 to 7,000 and $Mw_2/Mw_3$ is from 1.2 to 10, and preferably from 2 to 8;

dispersing the polymerizable monomer composition in an aqueous medium to form particles of the polymerizable monomer composition;

causing the polyester resin to localize on the surfaces of the particles of the polymerizable monomer composition;

polymerizing the polymerizable monomers present in the particles to form a binder resin for toner particles, where the binder resin is a styrene polymer, a styrene copolymer, or a mixture of these, and has a weight average molecular weight ($Mw_1$) of from 10,000 to 1,000,000; and adding a water-soluble polymerization initiator in the aqueous medium to modify the surfaces of the toner particles.

The polyester resin used in the present invention may preferably be contained in an amount of from 2 parts by weight to 30 parts by weight based on 100 parts by weight of the binder resin.

In the polyester resin used in the present invention, the THF-soluble matter may have $Mw_2$ of from 8,000 to 40,000 and the ethyl alcohol-soluble matter may have $Mw_3$ of from 1,000 to 5,000. This is preferable in order to form the polyester resin layer on the toner particle surface. Also, in the polyester resin, the $Mw_2$ of the THF-soluble matter and a number average molecular weight ($Mn_2$) of the THF-soluble matter may preferably be in a ratio ($Mw_2/Mn_2$ of from 1.2 to 3.5, and more preferably from 1.5 to 3.0, in order to make the polyester resin readily dissolve in the polymerizable monomers and improve the low-temperature fixing performance of the toner. The polyester resin may also preferably have a glass transition point (Tg) of from 50° to 95° C., and more preferably from 55 to 90° C., in order to improve the blocking resistance and low-temperature fixing performance of the toner. The polyester resin may also preferably has an acid value of from 5 to 35 mgKOH/g, in order to enable easy formation of the polyester resin layer on the toner particle surface and also to make the triboelectric charging performance stable in every environment.

The polyester resin used in the present invention may preferably contain the ethyl alcohol-soluble matter in an amount of from 0.1 to 20% by weight, and more preferably from 1 to 10% by weight. This is preferable because the polyester resin can localize with ease on the toner particle surface in the course of the production of the toner particles, and can prevent the blocking resistance of toner particles from lowering. When the toner particles are directly formed by granulating the polymerizable monomer composition having the polyester resin dissolved therein in the aqueous medium, the polyester resin can be made to localize on the outermost surfaces of the toner particles to such an extent that the ethyl alcohol-soluble matter of the polyester resin can be extracted from the toner particles when the toner particles are dispersed in ethyl alcohol and stirred for about 10 hours. In the case when the polyester resin having the ethyl alcohol-soluble matter stands localized on the toner particle surface, the modification degree of the toner particle surface with the water-soluble polymerization initiator can be enhanced, so that the triboelectric charging performance and blocking resistance of the toner particles can be more improved.

As an alcohol component of the polyester resin, it may include ethylene glycol, propylene glycol, butanediol, diethylene glycol, triethylene glycol, pentanediol, hexanediol, neopentyl glycol, hydrogenated bisphenol A, a bisphenol derivative represented by the following Formula (I);

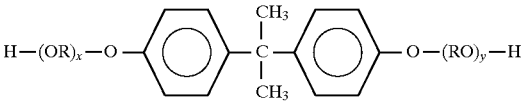

(I)

wherein R represents an ethylene group or a propylene group, x and y are each an integer of 1 or more, and an average value of x+y is 2 to 10;

and a diol represented by the following Formula (II).

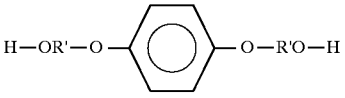

(II)

wherein R' represents

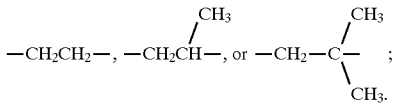

As the alcohol component, the bisphenol type diols represented by Formula (II) are preferable in order to improve the solubility of the polyester resin in styrene monomers.

As a dibasic acid component, it may include benzene dicarboxylic acids and anhydrides thereof, such as phthalic acid, terephthalic acid, isophthalic acid and phthalic anhydride; and alkyldicarboxylic acids such as succinic acid, adipic acid, sebacic acid and azelaic acid, and anhydrides thereof. In particular, aromatic dicarboxylic acids such as phthalic acid, phthalic anhydride and isophthalic acid are preferred. It may also include polyhydric alcohols such as glycerol, pentaerythritol, sorbitol, sorbitan, and oxyalkylene ethers of novolak type phenol resin; and polycarboxylic acids such as trimellitic acid, trimellitic anhydride, pyromellitic acid, benzophenonetetracarboxylic acid or anhydride thereof, which may be used in the production of the polyester resin to such an extent that the present invention is not adversely affected.

A particularly preferred alcohol component of the polyester resin is the bisphenol derivative represented by the above Formula (I). As the acid component, a combination of phthalic acid and isophthalic acid is preferred. The terminal (s) of the polymer chain of the polyester resin may also be modified with trihydric or higher polycarboxylic acid.

In the toner of the present invention, the low-temperature fixing performance and high-temperature anti-offset properties can be more preferably achieved when a styrene polymer, a styrene copolymer or a mixture of these is used as the binder resin component and the binder resin component has a weight average molecular weight ($Mw_1$) of from 50,000 to 900,000 as measured by GPC of its THF-soluble matter.

The styrene polymer or styrene copolymer can be formed by using styrene monomer as an essential component and any of the following vinyl type monomers in combination.

Styrene derivatives such as a-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene and p-phenylstyrene; acrylate type polymerizable monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate and 2-benzoyloxy ethyl acrylate; methacrylate type polymerizable monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate and dibutyl phosphate ethyl methacrylate; methylene aliphatic monocarboxylic acid esters; vinyl esters such as vinyl acetate, vinyl propionate, vinyl butyrate, vinyl benzoate and vinyl formate; vinyl ethers such as methyl vinyl ether, ethyl vinyl ether and isobutyl vinyl ether; and vinyl ketones such as methyl vinyl ketone, hexyl vinyl ketone and isopropyl vinyl ketone. In particular, a styrene-acrylate copolymer formed of a styrene monomer and an acrylate type polymerizable monomer or a styrene-methacrylate copolymer formed of a styrene monomer and a methacrylate type polymerizable monomer is preferred. Such a styrene-acrylate copolymer or styrene-methacrylate copolymer may preferably be cross-linked with a cross-linking agent in order to broaden the fixing temperature range of the toner and improve its anti-offset properties.

As the cross-linking agent, compounds having at least two polymerizable double bonds may be used, including, for example, aromatic divinyl compounds such as divinyl benzene and divinyl naphthalene; carboxylic acid esters having two double bonds such as ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having at least three vinyl groups. Any of these may be used alone or in the form of a mixture.

The binder resin component may preferably contain 0.1 to 20% by weight, and more preferably from 1 to 15% by weight of toluene-insoluble matter in order to improve the high-temperature anti-offset properties of the toner.

The release agent may preferably be a solid wax which is solid at room temperature (about 20° to 30° C.), in order to improve the multiple-sheet running performance of the toner and the light transmission properties of fixed images.

The release agent may preferably be a low-softening point substance having a main endothermic peak value at 55° to 120° C., and more preferably 60° to 90° C., in the DSC endothermic curve as measured according to ASTM D3418-8. In particular, it may more preferably be a low-softening point substance having a tangent takeoff temperature of the DSC curve, at 40° C. or above. If the low-softening point substance has a main endothermic peak below 55° C., because of its weak self-cohesive power it is difficult to form a core or a center in the toner particles, and the low-softening point substance may be deposited on the toner particle surfaces during the production of toner particles, adversely affecting developing performance. If the tangent takeoff temperature becomes below 40° C., the strength of toner particles may lower to tend to cause a lowering of developing performance. Fixed images obtained also tend to feel sticky, because of the low melting point of the low-softening point substance.

Figure 3:
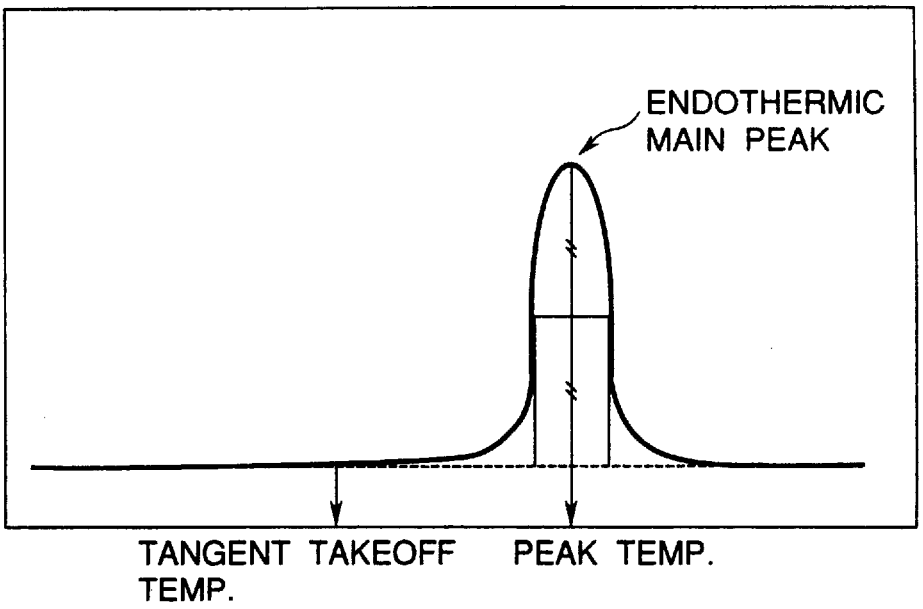
FIG. 3 shows a DSC endothermic curve of a release agent.

If, on the other hand, the low-softening point substance has a main endothermic peak at above 120° C., it exudes with difficulty at the time of fixing, resulting in a lowering of the low-temperature fixing performance. In the case when the toner particles are produced by direct polymerization, the solubility of such a low-softening point substance in the polymerizable monomer composition may be so low that it may deposit while the polymerizable monomer composition is granulated in the aqueous medium into droplets having the size of toner particles, to undesirably make it difficult to continue the granulation. More preferably the low-softening point substance may have the peak within the range of from 60° to 90° C., and most preferably from 60° to 85° C. The DSC endothermic curve of the low-softening point substance is shown in FIG. 3. The low-softening point substance may also preferably have sharp melting properties such that the half-width of the main endothermic peak is 10° C. or less, and more preferably 5° C. or less.

The low-softening point substance may specifically include paraffin wax, polyolefin wax, Fischer-Tropsch wax, amide waxes, higher fatty acids, higher alcohol ester waxes, and derivatives thereof such as graft compounds or block compounds thereof, which are solid at room temperature. Ester waxes having at least one long-chain ester moiety having at least 10 carbon atoms as shown by the following structural formulas are particularly preferred as being effective for the high temperature anti-offset properties without impairment of the transparency required for OHP. Structural formulas of the typical compounds of specific ester waxes preferable in the present invention are shown below as general structural formulas (1) to (6).

Ester Wax General Structural Formula (1)

$$[R_1—COO—(CH_2)_n—]_a—C—[—(CH_2)_m—OCO—R_2]_b$$

wherein a and b each represent an integer of 0 to 4, provided that a+b is 4; $R_1$ and $R_2$ each represent an organic group having 1 to 40 carbon atoms, provided that a difference in the number of carbon atoms between $R_1$ and $R_2$ is 10 or more; and n and m each represent an integer of 0 to 15, provided that n and m are not 0 at the same time.

Ester Wax General Structural Formula (2)

$$[R_1—COO—(CH_2)_n—]_a—C—[—(CH_2)_m—OH]_b$$

wherein a and b each represent an integer of 0 to 4, provided that a+b is 4; $R_1$ represents an organic group having 1 to 40 carbon atoms; and n and m each represent an integer of 0 to 15, provided that n and m are not 0 at the same time.

Ester Wax General Structural Formula (3)

$$[R_1—COO—(CH_2)_n—]_a—C(—R_3)—[—(CH_2)_m—OCO—R_2]_b$$

wherein a and b each represent an integer of 0 to 3, provided that a+b is 3 or less; $R_1$ and $R_2$ each represent an organic group having 1 to 40 carbon atoms, provided that a difference in the number of carbon atoms between $R_1$ and $R_2$ is 10 or more; $R_3$ represents an organic group having 1 or more carbon atoms; and n and m each represent an integer of 0 to 15, provided that n and m are not 0 at the same time.

Ester Wax General Structural Formula (4)

$$R_1—COOR_2$$

wherein $R_1$ and $R_2$ each represent a hydrocarbon group having 1 to 40 carbon atoms; and $R_1$ and $R_2$ may have the number of carbon atoms which is the same or different from each other.

Ester Wax General Structural Formula (5)

$$R_1COO(CH_2)_nOOCR_2$$

wherein $R_1$ and $R_2$ each represent a hydrocarbon group having 1 to 40 carbon atoms; n represents an integer of 2 to 20; and $R_1$ and $R_2$ may have the number of carbon atoms which is the same or different from each other.

Ester Wax General Structural Formula (6)

$$R_1OOC—(CH_2)_nCOOR_2$$

wherein $R_1$ and $R_2$ each represent a hydrocarbon group having 1 to 40 carbon atoms; n represents an integer of 2 to 20; and $R_1$ and $R_2$ may have the number of carbon atoms which is the same or different from each other.

The ester wax preferably used in the present invention may have a melt viscosity measured at 100° C., of form 1 to 50 mPa×sec. The melt viscosity of the ester wax is measured by, for example, using Viscotester VT500, manufactured by HAAKE Co. If the wax has a melt viscosity less than 1 mPa×sec, the high-temperature anti-offset properties can be less effective. If on the other hand the wax has a melt viscosity more than 50 mPa×sec, it exudes with difficulty at the time of fixing, resulting in a lowering of low-temperature fixing performance.

As to the molecular weight, the low-softening point substance may preferably have a weight average molecular weight (Mw) of from 300 to 1,500. If the low-softening point substance has an Mw less than 300, it tends to come bare to the toner particle surfaces, and if it has an Mw more than 1,500, the low-temperature fixing performance may lower. In particular, those having an Mw within the range of from 400 to 1,250 are preferred. When the ratio of weight average molecular weight to number average molecular weight (Mw/Mn) is 1.5 or below, the low-softening point substance can have a sharper maximum peak of the DSC endothermic curve, so that the mechanical strength of the toner particles at room temperature is improved, and especially good toner performances can be obtained, showing sharp melt characteristics at the time of fixing.

The molecular weights of the low-softening point substance are measured by GPC under conditions shown below.

GPC Measurement Conditions

Apparatus: GPC-150C (Waters Co.)

Column: Dual GMH-HT 30 cm coloumns (available from Toso Co., Ltd.)

Temperature: 135° C.

Solvent: o-Dichlorobenzene (0.1% ionol-added)

Flow rate: 1.0 ml/min

Sample: 0.4 ml of 0.15% sample is injected.

Molecular weights are measured under conditions shown above. Molecular weights of the sample are calculated using a molecular weight calibration curve prepared from monodisperse polystyrene standard samples. The calculated values are further calculated by converting the value in terms of polyethylene according to a conversion expression derived from the Mark-Houwink viscosity equation.

Specific examples of the low-softening point substance may include the following compounds.

(1) $CH_3(CH_2)_{20}COO(CH_2)_{21}CH_3$ (2) $CH_3(CH_2)_{17}COO(CH_2)_9OOC(CH_2)_{17}CH_3$ (2) $CH_3(CH_2)_{17}COO(CH_2)_{18}COO(CH_2)_{17}CH_3$

In recent years, the requirement for forming full-color images on both sides of the medium. When double-sided images are formed on both side, there is a possibility that a toner image first formed on one surface of the transfer medium again passes through the heating section of a fixing assembly when another image is next formed on the back. Thus, the high-temperature anti-offset properties of the fixed toner images on that course must be well taken into account. For this purpose also, it is preferable in the present invention to use the release agent in an amount of from 5 to 40 parts by weight, and more preferably from 12 to 35 parts by weight, based on 100 parts by weight of the binder resin or 100 parts by weight of the polymerizable monomers. Most preferably, the release agent may be contained in an amount of 12 to 30% by weight based on the weight of the toner particles, in order to improve low-temperature anti-offset properties and high-temperature anti-offset properties.

As the colorant used in the present invention, known pigments may be used.

For example, black pigments may include carbon black, aniline black, non-magnetic ferrite and magnetite.

Yellow pigments may include naples yellow, Naphthol Yellow S, Hanza Yellow G, Hanza Yellow 10G, Benzidine Yellow G, Benzidine Yellow GR, Quinoline Yellow Lake, Permanent Yellow NCG, and Tartrazine Yellow Lake.

Orange (reddish yellow) pigments may include Permanent Orange GTR, Pyrazolone Orange, Vulcan Fast Orange, Benzidine Orange G, Indanthrene Brilliant Orange RK, and Indanthrene Brilliant Orange GK.

Red pigments may include Permanent Red 4R, Lithol Red, Pyrazolone Red, Watching Red calcium salt, Lake Red C, Lake Red D, Brilliant Carmine 6B, Brilliant Carmine 3B, Eosine Lake, Rhodamine Lake, and Alizarine Lake.

Blue pigments may include Alkali Blue Lake, Victoria Blue Lake, Phthalocyanine Blue, metal-free Phthalocyanine Blue, Phthalocyanine Blue partial chloride, Fast Sky Blue, and Indanthrene Blue BG.

Violet pigments may include Fast Violet B, and Methyl Violet Lake.

Green pigments may include Pigment Green B, Malachite Green Lake, and Final Yellow Green G.

White pigments may include zinc white, titanium oxide, antimony white, and zinc sulfide.

Any of these pigments may be used alone, in the form of a mixture, or in the state of a solid solution.

The colorants used in the present invention are selected taking account of hue angle, chroma, brightness, weatherability, OHP transparency and dispersibility in toner particles. The colorant may usually be added in an amount of from 1 to 20 parts by weight based on 100 parts by weight of the binder resin. In the case when a magnetic material is used as the black colorant, it may be used in an amount of from 30 to 150 parts by weight based on 100 parts by weight of the binder resin, which is different from the amount of other colorant.

In the case when the toner for developing electrostatic images according to the present invention is used as a light-transmissive color toner, cyan colorants, magenta colorants and yellow colorants as shown below may be used.

As the cyan colorants, copper phthalocyanine compounds and derivatives thereof, anthraquinone compounds, basic dye chelate compounds and so forth may be used. Stated specifically, C.I. Pigment Blue 1, 7, 15:1, 15:2, 15:3, 15:4, 60, 62, 66, etc. may be particularly preferably used.

As the magenta colorants, condensation azo compounds, diketopyropyyrole compounds, anthraquinone compounds, quinacridone compounds, basic dye chelate compounds, naphthol compounds, benzimidazolone compounds, thioindigo compounds and perylene compounds may be used. Stated specifically, C.I. Pigment Red 2, 3, 5, 6, 7, 23, 48:2, 48:3, 48:4, 57:1, 81:1, 122, 146, 166, 169, 177, 184, 185, 202, 206, 220, 221 and 254 are particularly preferable.

As the yellow colorants, compounds typified by condensation azo compounds, isoindolinone compounds, anthraquinone compounds, azo metal complexes, methine compounds and allylamide compounds may be used. Stated specifically, C.I. Pigment Yellow 12, 13, 14, 15, 17, 62, 74, 83, 93, 94, 95, 109, 110, 111, 128, 129, 147, 168, 180, etc., are preferably used.

Thesee colorants may be used alone, in the form of a mixture, or in the state of a solid solution. The colorants are selected taking account of hue angle, chroma, brightness, weatherability, OHP transparency and dispersibility in toner particles. These colorants may be added in an amount of from 1 to 20 parts by weight based on 100 parts by weight of the binder resin.

In the present invention, since the toner particles are produced by polymerization, attention must be paid to polymerization inhibitory action or aqueous-phase transfer properties inherent in the colorants. The surfaces of colorants may be subjected to hydrophobic treatment using materials free from polymerization inhibition, to carry out surface modification. In particular, most dye type colorants and carbon black have the polymerization inhibitory action and hence care must be taken when used.

A preferable method for the surface treatment of the dyes may include a method in which polymerizable monomers are previously polymerized in the presence of any of these dyes. The resulting colored polymer may be added to the polymerizable monomer composition. With regard to the carbon black, besides the same treatment as the above on the dyes, it may be treated with a material capable of reacting with surface functional groups of the carbon black, as exemplified by organosiloxane.

When the toner of the present invention is used as a magnetic toner, it may be incorporated with magnetic powder. As the magnetic powder, materials capable of being magnetized when placed in a magnetic field are used, which include, for example, powders of ferromagnetic metals such as iron, cobalt and nickel, and powders of magnetic iron oxides such as magnetite and ferrite.

Since the toner particles are produced by polymerization, attention must be paid to polymerization inhibitory action or aqueous-phase transfer properties inherent in the magnetic materials. The surfaces of magnetic materials may preferably have been subjected to surface modification (e.g., hydrophobic treatment using materials free from polymerization inhibition).

In the present invention, for the purpose of controlling chargeability, it is preferable to add a negative charge control agent to the toner particles.

As the negative charge control agent, those almost free of polymerization inhibitory action or aqueous-phase transfer properties are preferred among known agents. In particular, metal compounds of salicylic acid, alkylsalicylic acid or naphthoic acid are preferred.

The negative charge control agent may be added in an amount of from 0.1 to 10% by weight based on the weight of the binder resin or polymerizable monomers.

As one of methods for producing the toner for developing electrostatic images according to the present invention, the binder resin, a method for producing toner by pulverization is available, according to which the colorant, the polar resin and the release agent, and as other optional components, the charge control agent and other additives, are kneaded and uniformly dispersed using a pressure kneader or extruder, or a media dispersion machine or the like, and thereafter the product is caused to collide against a target by a mechanical means or through a jet stream so as to be finely pulverized to have the desired toner particle diameters, further followed by classification to make the particle size distribution sharp to produce the toner particles. Besides this method, toner particles may be produced by the method disclosed in Japanese Patent Publication No. 36-10231 and Japanese Patent Application Laid-open No. 59-53856 and No. 59-61842 in which toner particles are directly produced by suspension polymerization; the interfacial association method in which at least one kind of fine particles are agglomerated to obtain particles with the desired diameters; the dispersion polymerization method in which toner particles are directly produced using an aqueous organic solvent in which monomers are soluble and polymers obtained are insoluble; and the emulsion polymerization method as typified by soap-free polymerization in which toner particles are produced by direct polymerization in the presence of a water-soluble polymerization initiator.

In the method of producing toner particles by polymerization, it is preferable to add the colorant and polar resin to the polymerizable monomer composition and further add the release agent and polymerization initiator to carry out granulation in an aqueous medium, further followed by polymerization reaction so that the release agent is encapsulated into toner particles by the polar resin and the polymer (binder resin) formed by the polymerization, to form an island-in-sea structure.

As methods by which the release agent is encapsulated into toner particles by the polar resin and the polymer (binder resin) formed by the polymerization, to form the island-in-sea structure, a method may be used in which the polarity of the release agent is set smaller than that of the main monomers in the aqueous medium and then the polar resin is added to polymerize the polymerizable monomers to thereby obtain a core-shell structure where the release agent is covered with the polar resin and the binder resin. The particles thus obtained may be used as the toner particles as they are, or the toner particles in the form of very fine particles may be agglomerated and associated into particles with the desired diameters to form the toner particles having the island-in-sea structure.

As the polymerizable monomers used when the toner of the present invention is produced by polymerization, vinyl type polymerizable monomers capable of radical polymerization with styrene monomers. As the vinyl type polymerizable monomers, monofunctional polymerizable monomers or polyfunctional polymerizable monomers may be used. The monofunctional polymerizable monomers may include styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene and p-phenylstyrene; acrylate type polymerizable monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate and 2-benzoyloxy ethyl acrylate; methacrylate type polymerizable monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate and dibutyl phosphate ethyl methacrylate; methylene aliphatic monocarboxylic acid esters; vinyl esters such as vinyl acetate, vinyl propionate, vinyl butyrate, vinyl benzoate and vinyl formate; vinyl ethers such as methyl vinyl ether, ethyl vinyl ether and isobutyl vinyl ether; and vinyl ketones such as methyl vinyl ketone, hexyl vinyl ketone and isopropyl vinyl ketone.

The polyfunctional polymerizable monomers may include diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis[4-(acryloxy.diethoxy)phenyl] propane, trimethylolpropane triacrylate, tetramethylolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis[4-(methacryloxy.diethoxy)phenyl]propane, 2,2'-bis[4-(methacryloxy.polyethoxy)phenyl]propane, trimethylolpropane trimethacrylate, tetramethylolmethane tetramethacrylate, divinyl benzene, divinyl naphthalene, and divinyl ether.

In the present invention, together with the styrene monomer, any of the above monofunctional polymerizable monomers are used alone or in combination of two or more kinds or any of the monofunctional polymerizable monomers and polyfunctional polymerizable monomers in combination. The polyfunctional polymerizable monomers may also be used as cross-linking agents.

As the polymerization initiator used when the polymerizable monomers are polymerized, an oil-soluble initiator and/or a water-soluble initiator may be used. For example, the oil-soluble initiator may include azo compounds such as 2,2'-azobisisobutyronitrile), 2,2'-azobis-(2,4-dimethylvaleronitrile), 1,1'-azobis-(cyclohexane-1-carbonitrile), and 2,2'-azobis-4-methoxy-2,4-dimethylvaleronitrile; and peroxide type initiators such as acetylcyclohexylsulfonyl peroxide, diisopropylperoxy carbonate, decanonyl peroxide, lauroyl peroxide, stearoyl peroxide, propionyl peroxide, acetyl peroxide, t-butylperoxy-2-ethylhexanoate, benzoyl peroxide, t-butylperoxyisobutyrate, cyclohexanone peroxide, methyl ethyl ketone peroxide, dicumyl peroxide, t-butyl hydroperoxide, di-t-butyl hydroperoxide, and cumene hydroperoxide.

The water-soluble initiator may include ammonium persulfate, potassium persulfate, 2,2'-azobis(N,N'-diemthyleneisobutyloamidine) hydrochloride, 2,2'-azobis(2-aminodipropane) hydrochloride, azobis(isobutyloamidine) hydrochloride, sodium 2,2'-azobisisobutylonitrile sulfonate, and ferrous sulfate or hydrogen peroxide.

In the present invention, in order to control the degree of polymerization of the polymerizable monomers, a chain transfer agent, a polymerization inhibitor or the like may be further added.

As a method for producing the toner of the present invention, the suspension polymerization is particularly preferred, which can uniformly control the shape of toner particles, can readily form toner particles having a sharp particle size distribution with a coefficient of number variation of 35% or less, and also can readily form toner particles with a small particle diameter of 3 to 8 μm in weight average particle diameter. The seed polymerization, in which monomers are further adsorbed on polymer particles once obtained and thereafter a polymerization initiator is added to carry out polymerization, may also be preferably employed in the present invention. In this seed polymerization, it is also possible to disperse or dissolve a polar compound in the monomers to be adsorbed. When the suspension polymerization is employed as the method for producing the toner, the toner particles can be directly produced by a production process as described below. A monomer composition comprising polymerizable monomers and added therein the low-softening point substance such as wax, the polymerization initiator, the cross-linking agent and other additives are added, which are uniformly dissolved or dispersed by means of a homogenizer, an ultrasonic dispersion machine or the like, is dispersed in an aqueous medium containing a dispersion stabilizer, by means of a conventional stirrer, homomixer, homogenizer or the like. Granulation is carried out preferably while controlling the stirring speed and time so that droplets of the monomer composition can have the desired toner particle size. After the granulation, stirring may be carried out to such an extent that the state of particles is maintained and the particles can be prevented from settling by the action of the dispersion stabilizer. The polymerization may be carried out at a temperature set at 40° C. or above, usually from 50° to 90° C., and preferably from 55° to 85° C. At the latter half of the polymerization reaction, the temperature may be raised, and also the aqueous medium may be removed in part by evaporation at the latter half of the reaction or after the reaction has been completed, in order to remove unreacted polymerizable monomers, by-products and so forth that may cause a smell when toner images are fixed. After the reaction has been completed, the toner particles formed are collected by washing and filtration, followed by drying.

In the suspension polymerization, water may preferably be used as the dispersion medium usually in an amount of from 300 to 3,000 parts by weight based on 100 parts by weight of the monomer composition. As the dispersion stabilizer used, it may include, for example, as inorganic compounds, tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica and alumina. As organic compounds, polyvinyl alcohol, gelatin, methyl cellulose, methyl hydroxypropyl cellulose, ethyl cellulose, carboxymethyl cellulose sodium salt, starch or the like may be used. Any of these dispersion stabilizers may preferably be used in an amount of 0.2 to 2.0 parts by weight based on 100 parts by weight of the polymerizable monomers.

As these dispersion stabilizers, those commercially available may be used as they are. In order to obtain dispersed particles having a fine and uniform particle size, the inorganic compound may also be formed in the dispersion medium under high-speed stirring. For example, in the case of tricalcium phosphate, an aqueous sodium phosphate solution and an aqueous calcium chloride solution may be mixed under high-speed stirring, whereby a dispersion stabilizer preferable for the suspension polymerization can be obtained. In order to make particles of these dispersion stabilizers finer, 0.001 to 0.1% by weight of a surface active agent may be used in combination. Stated specifically, commercially available nonionic, anionic or cationic surface active agents may be used. For example, those preferably used are sodium dodecylsulfate, sodium tetradecylsulfate, sodium pentadecylsulfate, sodium octylsulfate, sodium oleate, sodium laurate, potassium stearate and calcium oleate.

The aqueous medium may preferably have a pH of from 6.8 to 11 in order to cause the polyester resin to better localize on the surfaces of the particles of the polymerizable monomer composition.

In the treatment to modify the surfaces of toner particles by the use of a water-soluble polymerization initiator (preferably sodium persulfate or ammonium persulfate), which is carried out at the final step of the process of forming the toner particles or after the formation of the polyester resin, the water-soluble polymerization initiator may preferably be used in an amount of from 0.005 to 5 parts by weight, and more preferably from 0.01 to 5 parts by weight, based on 100 parts by weight of the toner particles.

The surface treatment of the toner particles by the use of the water-soluble polymerization initiator may preferably be carried out at a temperature of from 50° to 90° C. for 60 to 600 minutes.

The toner of the present invention may preferably be a toner having a shape factor SF-1 of from 100 to 150, and more preferably from 100 to 125.

In the present invention, the SF-1 indicating the shape factor is a value obtained by sampling at random 100 particles of the toner, enlarged by 500 magnifications, by the use of, e.g., FE-SEM (S-800; a scanning electron microscope manufactured by Hitachi Ltd.), introducing their image information in an image analyzer (LUZEX-III; manufactured by Nikore Co.) through an interface to make analysis, and calculating the data according to the following expression. The value obtained is defined as shape factor SF-1.

Shape factor SF-1=$(MXLNG)^2/AREA\times\pi/4\times100$ wherein MXLNG represents an absolute maximum length of a toner particle, and AREA represents a projected area of the toner particle.

The shape factor SF-1 indicates the degree of sphericity of toner particles.

A toner having a toner shape factor SF-1 greater than 150 becomes more amorphous (shapeless) than spherical, with which a lowering of transfer efficiency is seen.

Additives used for the purpose of improving various performances in the toner may preferably have a particle diameter not larger than ⅓ of the volume average diameter of toner particles in view of their durability. This particle diameter of the additives means an average particle diameter measured using an electron microscope by observing surfaces of toner particles. As these additives, used for the purpose of imparting various properties, the following can be used, for example.

As fluidity-providing agents, metal oxides such as silicon oxide, aluminum oxide and titanium oxide, carbon black, and carbon fluoride may be used. These may more preferably have been subjected to hydrophobic treatment.

As abrasives, metal oxides such as cerium oxide, aluminum oxide, magnesium oxide and chromium oxide, nitrides such as silicon nitride, carbides such as silicon carbide, and metal salts such as strontium titanate, calcium sulfate, barium sulfate and calcium carbonate may be used.

As lubricants, fluorine resin powders such as vinylidene fluoride and polytetrafluoroethylene, and fatty acid metal salts such as zinc stearate and calcium stearate may be used.

As charge controlling particles, metal oxides such as tin oxide, titanium oxide, zinc oxide, silicon oxide and aluminum oxide, and carbon black may be used.

Any of these additives may be used in an amount of from 0.05 part to 10 parts by weight, and preferably from 0.1 part to 5 parts by weight, based on 100 parts by weight of the toner particles. These additives may be used alone or in combination of some of these.

The toner of the present invention may respectively have the degree of agglomeration of from 1 to 30%, and more preferably from 2 to 20%, in view of developing performance.

The degree of agglomeration of the toner can be an index to make the judgement that when its value is small the toner has a high fluidity, and when its value is great, the toner has a low fluidity.

The degree of agglomeration of the toner is measured by the method described later.

Various properties of the toner and the materials constituting the toner are measured by the methods as described below.

Extraction of ethyl alcohol-soluble matter of polyester resin

In a container provided with a stirrer, 5 parts by weight of polyester resin pulverized to about 150 μm or smaller and 100 parts by weight of ethyl alcohol are introduced, which are then stirred at room temperature (about 25° C.) for 10 hours, followed by filtration to obtain an ethyl alcohol solution. From the weight loss of the polyester resin after the stirring, the content of the ethyl alcohol-soluble matter in the polyester resin is determined.

Meanwhile, ethyl alcohol is evaporated from the ethyl alcohol solution to determine the ethyl alcohol-soluble matter of the polyester resin. The ethyl alcohol-soluble matter is dissolved in THF and used for the measurement of molecular weight by GPC. Since THF has a higher solubility than ethyl alcohol, the ethyl alcohol-soluble matter is well dissolved in THF.

Measurement of acid value of polyester resin

In a 200 to 300 ml Erlenmeyer flask, 2 to 10 g of a resin sample is weighed and put, followed by addition of about 50 ml of a 30:70 mixed solvent of methanol and toluene to dissolve the resin. If it can not be well dissolved, acetone may be added in a small amount. Using a 0.1% by weight mixed reagent of Bromothymol Blue and Phenol Red, titration is made in N/10 potassium hydroxide-alcohol solution previously standardized, and the acid value is calculated from the consumption of the solution according the following expression.

$$\text{Acid value}=\text{KOH (ml number)}\times N\times 56.1/\text{sample weight}$$

wherein N represents a factor of N/10 KOH.

Measurement of glass transition Point of polyester resin

Glass transition point of polyester resin is measured by DSC (differential scanning calorimeter) measurement.

In the DSC measurement, in view of the principle of measurement, the measurement may preferably be carried out using a differential scanning calorimeter of a highly precise, inner-heat input compensation type. For example, it is possible to use DSC-7, manufactured by Perkin Elmer Co.

The measurement is carried out according to ASTM D3418-82. To make the measurement, temperature is once raised and then dropped to take a previous history and thereafter the temperature is raised at a temperature rate of 10° C./min.

The point at which the line at a middle point of the base lines before and after appearance of the endothermic peak obtained and the differential thermal curve intersect is regarded as the glass transition point Tg.

Separation of toluene-soluble matter and toluene-insoluble matter in polyester resin The toluene-insoluble matter (wt %) indicates the weight proportion of an ultrahigh-molecular weight polymer component that has become insoluble in solvent toluene (i.e., substantially a cross-linked polymer) in resin compositions of toner particles. The toluene-insoluble matter is defined by a value measured in the following way.

A toner sample is weighed in an amount of from 0.5 to 1.0 g ($W_1$ g), which is then put in a cylindrical filter paper (for example, No. 86R, available from Toyo Roshi K.K.) and set on a Soxhlet extractor. Extraction is carried out for 20 hours using from 100 to 200 ml of toluene as a solvent, and the soluble component extracted by the use of the solvent is evaporated, followed by vacuum drying at 100° C. for several hours. Then the toluene-soluble resin component is weighed ($W_2$ g). The weight of components other than the resin components, such as a pigment contained in the toner, is represented by $W_3$ g. The toluene-insoluble matter is determined from the following expression.

$$\text{Toluene-insoluble matter (\%)}=[\{(W_1-(W_3+W_2)\}/(W_1-W_3)]\times 100$$

Measurement of molecular weight distribution of THF-soluble matter of resin composition:

In the case of polyester resin, a sample for GPC measurement is prepared in the following way.

Polyester resin is put in tetrahydrofuran (THF), which is then left to stand for several hours, followed by thorough shaking to well mix the resin with THF (until no visible coalesced polyester is present), and the mixture is left to stand still for at least 12 hours. Here, leaving time in THF is set to be at least 24 hours. Thereafter, the mixture is passed through a sample-treating filter (for example, MYSHORI DISK H-25-5, available from Toso Co., Ltd., or EKICRO-DISC 25CR, available from German Science Japan, Ltd., may be used). The solution obtained is used as the sample for GPC. The concentration of the polyester resin is controlled to be 0.5 to 5 mg/ml as resin component.

In the case of the binder resin, toluene is evaporated from a toluene extract of toner, and the solid matter obtained is mixed with chloroform to obtain a chloroform dispersion. The chloroform dispersion is filtered so as to be separated into chloroform-insoluble solid matter and a filtrate of chloroform solution. From the filtrate, chloroform is evaporated, and the solid matter obtained is mixed with THF to prepare the sample for GPC measurement in the same manner as in the case of the polyester resin.

The molecular weights and molecular weight distributions of the THF-soluble matter of the polyester resin and the THF-soluble matter of the binder resin as measured by GPC are measured in the following way.

Columns are stabilized in a heat chamber of 40° C. To the columns kept at this temperature, THF as a solvent is flowed at a flow rate of 1 ml per minute, and about 100 $\mu$l of THF sample solution is injected thereinto to make measurement. In measuring the molecular weight of the sample, the molecular weight distribution ascribed to the sample is calculated from the relationship between the logarithmic value and count number of a calibration curve prepared using several kinds of monodisperse polystyrene standard samples. As the standard polystyrene samples used for the preparation of the calibration curve, it is suitable to use samples with molecular weights of from 100 to 1,000,000, which are available from Showa Denko KK. or Toso Co., Ltd., and to use at least about 10 standard polystyrene samples. An RI (refractive index) detector is used as a detector. Columns should be used in combination of a plurality of commercially available polystyrene gel columns. For example, they may preferably comprise a combination of Shodex GPC KF-801, KF-802, KF-803, KF-804, KF-805, KF-806, KF-807 and KF-800P, available from Showa Denko K.K.; or a combination of TSKgel G1000H ($H_{XL}$), G2000H($H_{XL}$), G3000H($H_{XL}$), G4000H($H_{XL}$), G5000H($H_{XL}$), G6000H($H_{XL}$), G7000H($H_{XL}$) and TSK guard column, available from Toso Co., Ltd.

In particular, columns constituted by connecting A-801, A-802, A-803, A-804, A-805, A-806 and A-807, available from Showa Denko K.K., are preferred.

Measurement of molecular weight distribution of release agent

The average molecular weight and molecular weight distribution of the release agent are measured by GPC under conditions shown below.

GPC Measurement Conditions

Apparatus: GPC-150C (Waters Co.)

Column: GMH-HT 30 cm, dual columns (available from Toso Co., Ltd.)

Temperature: 135° C.

Solvent: o-Dichlorobenzene (0.1% ionol-added)

Flow rate: 1.0 ml/min

Sample: 0.4 ml of 0.15% sample is injected.

Molecular weight is measured under conditions shown above. Molecular weight of the sample is calculated using a molecular weight calibration curve prepared from monodisperse polystyrene standard samples. The calculated value is further calculated to convert the value in terms of polyethylene according to a conversion expression derived from the Mark-Houwink viscosity equation.

Measurement of particle size distribution of toner

As a measuring device, a Coulter counter Model TA-II or Coulter Multisizer (manufactured by Coulter Electronics, Inc.) is used. As an electrolytic solution, an aqueous 1% NaCl solution is prepared using first-grade sodium chloride. For example, ISOTON R-II (trade name, Coulter Multisizer, manufactured by Coulter Scientific Japan Co.) may be used. For measurement, 0.1 to 5 ml of a surface active agent as a dispersant, preferably an alkylbenzene sulfonate, is added to 100 to 150 ml of the above aqueous electrolytic solution, to which 2 to 20 mg of a sample to be measured is added. The electrolytic solution in which the sample has been suspended is subjected to dispersion for about 1 minute to about 3 minutes in an ultrasonic dispersion machine. The volume distribution and number distribution of the toner are calculated by measuring the volume and number of toner particles by means of the Coulter Multisizer, using an aperture of 100 μm as its aperture. Then the weight-based, weight average particle diameter (D4: the middle value of each channel is used as the representative value for each channel) determined from the volume distribution of toner particles are determined.

As channels, 13 channels are used, which are of 2.00 to 2.52 μm, 2.52 to 3.17 μm, 3.17 to 4.00 μm, 4.00 to 5.04 μm, 5.04 to 6.35 μm, 6.35 to 8.00 μm, 8.00 to 10.08 μm, 10.08 to 12.70 μm, 12.70 to 16.00 μm, 16.00 to 20.20 μm, 20.20 to 25.40 μm, 25.40 to 32.00 μm, and 32.00 to 40.30 μm.

Measurement of coefficient of number variation of toner

Coefficient of variation A in the number distribution of the toner is calculated according to the following expression.

$$\text{Coefficient of variation } A=[S/D_1]\times 100$$

wherein S represents a value of standard deviation in the number distribution of toner particles, and $D_1$ represents number average particle diameter (μm) of the toner particles.

Measurement of degree of agglomeration of toner

A vibration sieve, Powder Tester (manufactured by Hosokawa Micron Corporation), is used, and 400 mesh, 200 mesh and 100 mesh sieves are set in the order of mesh size, i.e., in the order of 400 mesh, 200 mesh and 100 mesh sieves from the bottom so that the 100 mesh sieve comes uppermost.

On the 100 mesh sieve of the sieves set in this way, a sample is placed, the input voltage applied to the vibrating pedestal is set to 15 V, where the vibrational amplitude of the vibrating pedestal is so adjusted as to be within the range of 60 to 90 μm, and the sieves are vibrated for about 25 seconds. Then, the weight of the sample that has remained on each sieve is measured to calculate the degree of agglomeration according to the following expression.

$$\text{Degree of agglomeration (\%)} = \frac{\text{Sample weight (g) on 100 mesh sieve}}{5\text{ g}} \times 100 +$$

-continued $$\frac{\text{Sample weight (g) on 200 mesh sieve}}{5\text{ g}} \times 100 \times 0.6 + \frac{\text{Sample weight (g) on 400 mesh sieve}}{5\text{ g}} \times 100 \times 0.2$$

Toner blocking resistance test

About 10 g of toner is put in a 100 cc polyethylene tumbler, and left to stand at 50° C. for 3 days. Thereafter, its state is visually evaluated.

A: No aggregates are seen.

B: Aggregates are seen, but readily collapsible.

C: Aggregates are seen, but collapsible upon shaking.

D: Aggregates can be held with the fingers and are not readily collapsible.

(Indicated as the item "Anti-blocking" in Table 2 later.)

Measurement of charge quantity of toner in environment

To measure environmental charge quantity, toner and carrier are left to stand overnight in each environment, and then their charge quantities are measured in the following way.

In environments of high temperature/high humidity (30° C./80% RH) and low temperature/low humidity (15° C./10% RH), for example, quantity of triboelectricity of toner is measured by the blow-off method.

Figure 1:
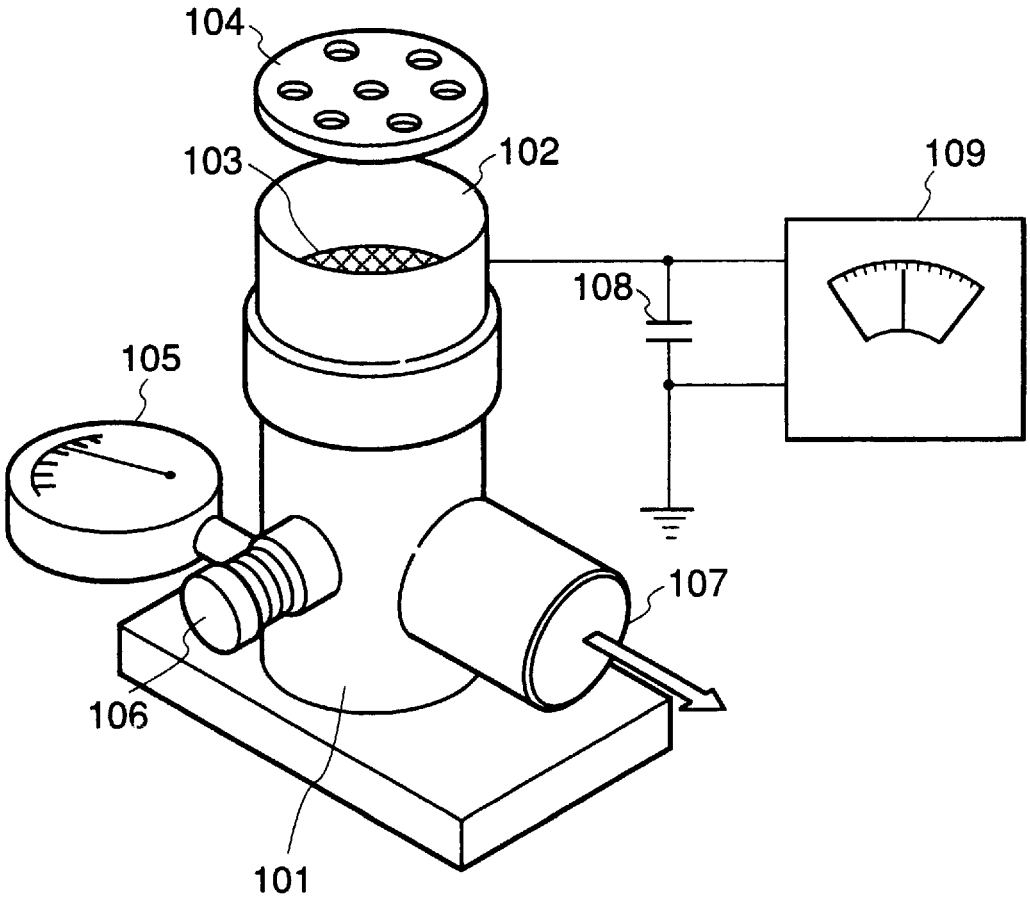
FIG. 1 schematically illustrates a measuring device for measuring the quantity of triboelectricity of toner.

FIG. 1 illustrates a device for measuring the quantity of triboelectricity of toner. First, a 1:19 mixture (weight ratio) of toner and carrier on which toner the quantity of triboelectricity is to be measured is put in a 50–100 ml polyethylene bottle, and manually shaken for 5 to 10 minutes. Then, about 0.5 to 1.5 g of the mixture (developer) is put in a measuring metal container 102 having a screen 103 of 500 meshes at the bottom, and the container is covered with a metal plate 104. The total weight of the measuring container 102 at this time is weighed and is expressed as $W_1$ (g). Next, in a suction device 101 (made of an insulating material at least at the part coming into contact with the measuring container 102), air is sucked from a suction opening 107 and an air-flow control valve 106 is operated to control the pressure indicated by a vacuum indicator 105, to be 250 mmAq. In this state, suction is well carried out, preferably for 2 minute, to remove the toner by suction. The potential indicated by a potentiometer 109 at this time is expressed as V (volt). Herein, the numeral 108 denotes a capacitor, whose capacitance is expressed as C (μF). The total weight of the measuring container after completion of the suction is also weighed and is expressed as $W_2$ (g). The quantity of triboelectricity (mC/kg) of the toner is calculated as shown by the following expression.

$$\text{Quantity of triboelectricity (mC/g) of toner}=(C\times V)/(W_1-W_2)$$

Measurement of quantity of triboelectricity of toner on developing sleeve

The quantity of triboelectricity of toner on a developing sleeve is determined by the suction type Faraday's gauge method.

In this method, the outer cylinder of a gauge is pressed against the surface of the developing sleeve and the toner in a certain area on the developing sleeve is collected by suction on a filter of the inner cylinder so that the weight of the toner sucked in can be calculated from the weight gain of the filter. At the same time, the quantity of triboelectricity of the toner on the developing sleeve can be determined by measuring the quantity of charge accumulated in the inner cylinder electrically shielded from the outside.

Measurement of DSC endothermic peak of release agent

Measured according to ASTM D3418-82, using a differential thermal analyzer (DSC measuring device) DSC-7 (manufactured by Perkin Elmer Co.). The sample for measurement is precisely weighed within the range of 2 to 10 mg. This sample is put in a pan made of aluminum and an empty pan is set as reference. Measurement is carried out in an environment of normal temperature/normal humidity at a temperature rate of 10° C./min within the measuring temperature range of from 30° to 160° C. The half width of a main endothermic peak refers to the temperature width of the endothermic curve at the position of ½ of the height of the main endothermic peak.

Next, a specific example of a multi-color or full-color image forming apparatus to which the present invention is applicable as a cyan toner, a magenta toner, a yellow toner and/or a black toner will be described with reference to FIG. 4.

Figure 4:
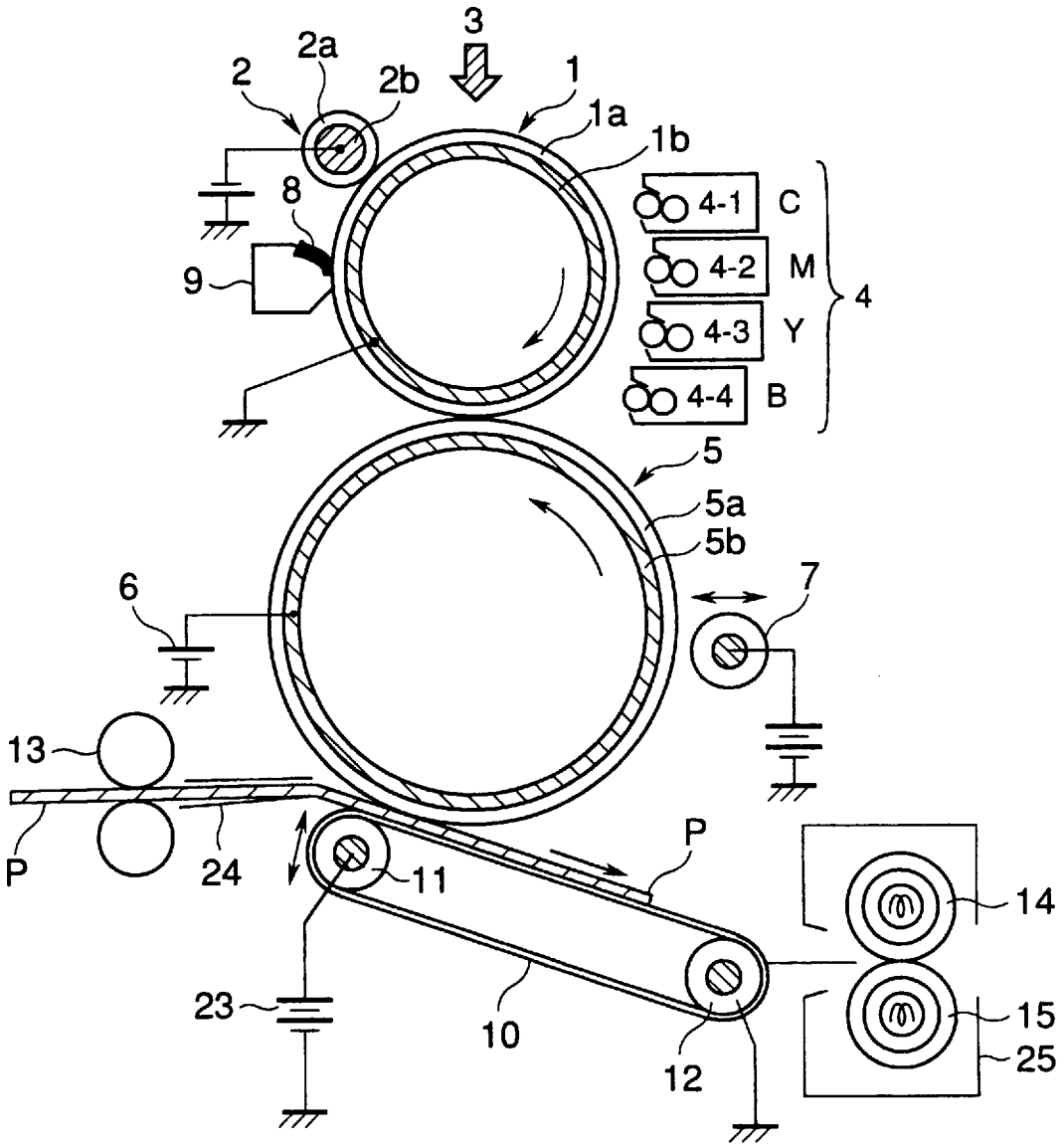
FIG. 4 schematically illustrates an example of an image forming apparatus to which the toner of the present invention can be applied.

FIG. 4 is a schematic cross-sectional view of an image forming apparatus (a copying machine or a laser printer) that can form monochromatic images, multi-color images and full-color images, utilizing an electrophotographic process. It employs a medium-resistance elastic roller 5 as an intermediate transfer member, and a transfer belt 10 as a secondary contact transfer means.

Reference numeral 1 denotes a rotary drum type electrophotographic photosensitive member (hereinafter "photosensitive member"), a repeatedly usable image bearing member, and is rotatingly driven at a given peripheral speed (process speed) in the clockwise direction as shown by an arrow. The photosensitive member 1 may be a photosensitive drum or photosensitive belt having a photoconductive insulating material layer formed of α-Se, CdS, $ZnO_2$, OPC or α-Si.

Preferably used, the photosensitive member 1 is a photosensitive member having an amorphous silicon photosensitive layer or an organic photosensitive layer.

The organic photosensitive layer may be of a single-layer type in which the photosensitive layer contains a charge generating material and a charge transporting material in the same layer, or may be a function-separated photosensitive layer comprised of a charge transport layer and a charge generation layer. A multi-layer type photosensitive layer comprising a conductive substrate and superposingly formed thereon the charge generation layer and the charge transport layer in this order is one of preferred examples.

As binder resins for the organic photosensitive layer, polycarbonate resins, polyester resins or acrylic resins have an especially good transfer performance and cleaning performance, and may hardly cause faulty cleaning, melt-adhesion of toner to the photosensitive member and filming of external additives.

The step of charging has a system making use of a corona charging assembly and being in non-contact with the photosensitive member 1, or a contact type system making use of a roller or the like. Either system may be used. The contact type system as shown in FIG. 4 is preferably used so as to enable efficient and uniform charging, simplify the system and make ozone less occur.

A charging roller 2 is basically comprised of a mandrel 2*b* and a conductive elastic layer 2*a* that forms the periphery of the former. The charging roller 2 is brought into pressure contact with the surface of the photosensitive member 1 and is rotated followingly as the photosensitive member 1 is rotated.

When the charging roller is used, the charging process may preferably be performed under conditions of a roller contact pressure of 5 to 500 g/cm, and an AC voltage of 0.5 to 5 kVpp, an AC frequency of 50 Hz to 5 kHz and a DC voltage of plus-minus 0.2 to plus-minus 1.5 kV when an AC voltage is superimposed on a DC voltage, and a DC voltage of from plus-minus 0.2 to plus-minus 5 kV when a DC voltage is used.

As other charging means than the charging roller, there is a method making use of a charging blade and a method making use of a conductive brush.

The charging roller and charging blade as contact charging means may preferably be made of a conductive rubber, and a release coat may be provided on its surface. The release coat may be formed of a nylon resin, PVDF (polyvinylidene fluoride) or PVDC (polyvinylidene chloride), any of which can be used.

The photosensitive member 1 is, in the course of its rotation, is uniformly charged to stated polarity and potential by means of the primary charging roller 2, and subsequently subjected to imagewise exposure 3 through an image exposure means (not shown) (e.g., an optical exposure system for color separation and image formation of color original images, or a scanning exposure system employing a laser scanner that outputs laser beams modulated in accordance with time-sequential electrical digital pixel signals of image information), so that an electrostatic image is formed which corresponds to an intended first color component image (e.g., a cyan component image).

Subsequently, the electrostatic image thus formed is developed by a first-color cyan toner in a first developing assembly 4-1 (a cyan developing assembly. The developing assembly 4-1 is a process unit and is detachable from the body of the image forming apparatus. An enlarged view of the developing assembly 4-1 is shown in FIG. 5.

Figure 5:
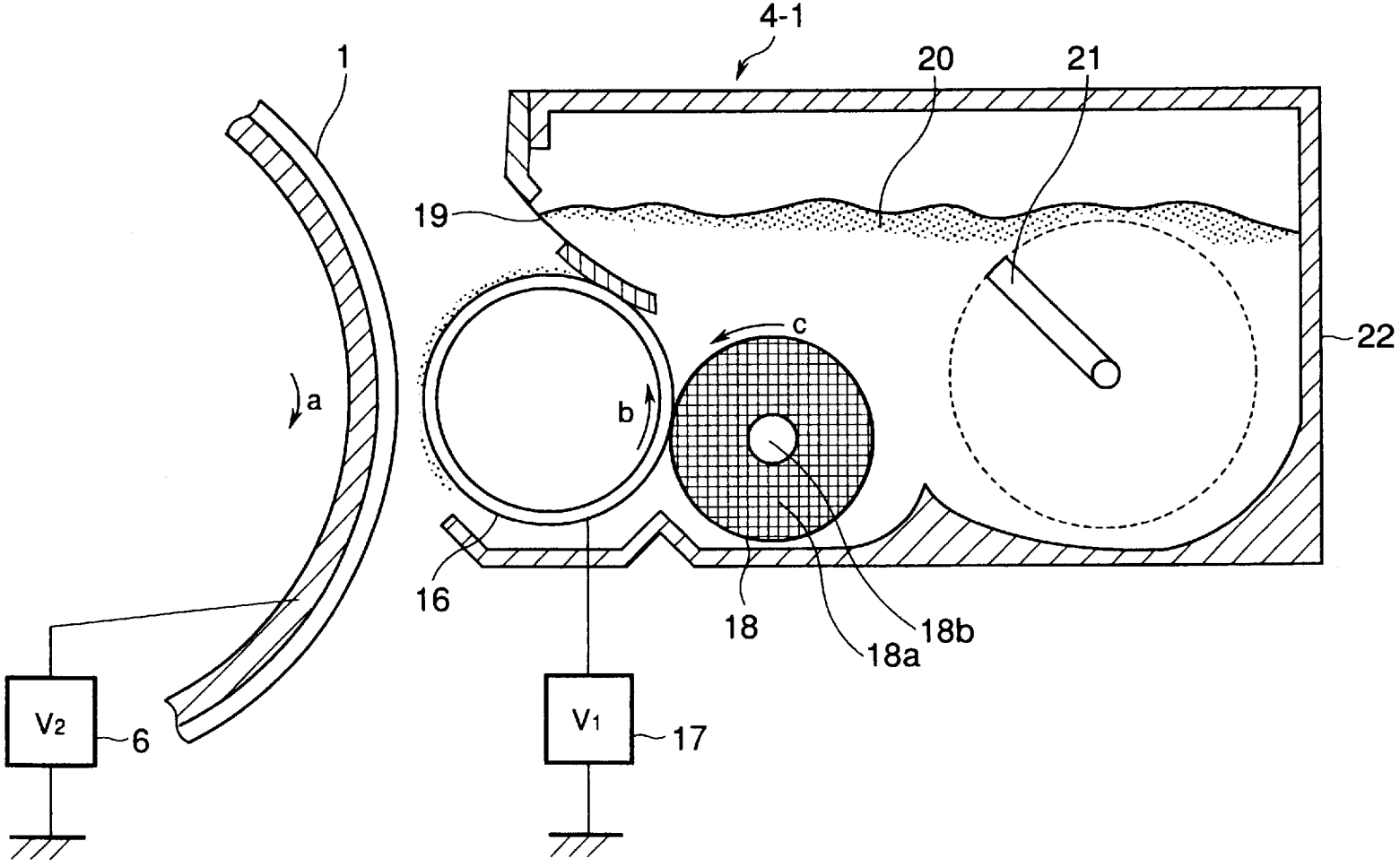
FIG. 5 schematically illustrates an example of a process unit of the image forming apparatus shown in FIG. 4.

In FIG. 5, reference numeral 22 denotes an assembly housing. Inside the assembly housing 22, a developing sleeve 16 serving as a toner carrying member is provided, which is provided opposingly to the photosensitive member 1 rotated in the direction of an arrow as shown in the drawing and develops with the toner the electrostatic image on the photosensitive member 1 to form a toner image. The developing sleeve 16 is rotatably laterally provided in such a manner that the about right half of its periphery is in the assembly housing 22 as viewed in the drawing, and the about left half of its periphery is exposed outside of the assembly housing 22. A minute gap is provided between the developing sleeve 16 and the photosensitive member 1. The developing sleeve 16 is rotated in the direction of arrow b against the rotational direction a of the photosensitive member 1.

The developing sleeve 16 need not be limited to the cylindrical developing sleeve as shown in the drawing, and may have the form of an endless belt that is rotatingly driven. A conductive rubber roller may be used.

Inside the assembly housing 22, an elastic blade 19 is provided as an elastic, toner layer thickness control member on the upper position of the developing sleeve 16. A toner coating roller 18 is also provided at the position upstream in the rotational direction of the developing sleeve 16. An elastic roller may be used as the elastic control member for toner layer thickness.

The elastic blade 19 is provided obliquely in the downward direction toward the upstream side of the rotational direction of the developing sleeve 16, and is brought into touch with the upper periphery of the developing sleeve 16 against its rotational direction.

The toner coating roller 18 is provided in contact with the developing sleeve 16 on the side opposite to the photosensitive member 1, and is, rotatably supported.

In the developing assembly 4-1, constituted as described above, the toner coating roller 18 is rotated in the direction of an arrow c to carry the cyan toner 20 and feed it to the vicinity of the developing sleeve 16 as the toner coating roller 18 is rotated. The cyan toner 20 carried on the toner coating roller 18 is caused to rub against the surface of the developing sleeve 16 at the contact portion (nip portion) where the developing sleeve 16 and the toner coating roller 18 come into contact, so that the toner adheres to the surface of the developing sleeve 16.

With the rotation of the developing sleeve 16, the cyan toner 20 having adhered to the surface of the developing sleeve 16 comes into the contact portion between the elastic blade 19 and the developing sleeve 16, and is rubbed with both the surface of the developing sleeve 16 and the elastic blade 19 when passed there, so that the toner is provided with sufficient triboelectric charges.

The cyan toner thus triboelectrically charged is passed through the contact portion between the elastic blade 19 and the developing sleeve 16, so that a thin layer of the cyan toner 20 is formed on the developing sleeve 16, and is transported to the developing zone where the sleeve face the photosensitive member 1. To the developing sleeve 16, an alternating voltage formed by superimposing an alternating current on a direct current is applied as a development bias through a bias applying means 17, whereupon the cyan toner 20 carried on the developing sleeve 16 is transferred to the photosensitive member 1 correspondingly to the electrostatic image to adhere to the electrostatic image, so that the toner image is formed.

The cyan toner 20 not transferred to the photosensitive member 1 in the developing zone and having remained on the developing sleeve 16 is collected into the assembly housing 22 at the lower part of the developing sleeve 16 as the developing sleeve 16 is rotated.

The cyan toner 20 collected is scraped off by the toner coating roller 18 from the surface of the developing sleeve 16 at the contact portion between the toner coating roller 18 and the developing sleeve 16. At the same time, as the toner coating roller 18 is rotated, the cyan toner 20 is anew fed onto the developing sleeve 16, and the new cyan toner 20 is again transported to the contact portion between the developing sleeve 16 and the elastic blade 19.

Meanwhile, the greater part of the cyan toner 20 scraped off is mutually mixed with the toner 20 remaining in the assembly housing 22, where the triboelectric charges of the toner scraped off are dispersed. The toner present at the position distant from the toner coating roller 18 is successively fed to the toner coating roller 18 by means of an agitating means 21.

In the non-magnetic one-component developing process as described above, the toner of the present invention has good developing performance and multiple-sheet running performance.

As the developing sleeve 16, a conductive cylinder formed of a metal or alloy such as aluminum or stainless steel is preferably used. Alternatively, the conductive cylinder may be formed of a resin composition having a sufficient mechanical strength and conductivity. The developing sleeve 16 may also comprise a cylinder made of a metal or alloy, and provided on its surface a coat layer formed of a resin composition having conductive fine particles dispersed therein.

In the coat layer, a resin material containing conductive fine particles is used. The conductive fine particles may preferably be those having a resistivity of 0.5 Ω·cm or below after pressed at a pressured of 120 kg/cm$^2$.

As the conductive fine particles, fine carbon particles, a mixture of fine carbon particles with crystalline graphite, and crystalline graphite are preferred. The conductive fine particles may preferably be those having particle diameters of from 0.005 to 10 $\mu$m.

The resin material includes thermoplastic resins such as styrene resins, vinyl resins, polyether sulfone resin, polycarbonate resin, polyphenylene oxide resin, polyamide resins, fluorine resins, cellulose resins and acrylic resins, and thermosetting or photocurable resins such as epoxy resins, polyester resins, alkyd resins, phenol resins, melamine resins, polyurethane resins, urea resins, silicone resins and polyimide resins. In particular, those having release properties, such as silicone resins and fluorine resins, and those having superior mechanical strength, such as polyether sulfone, polycarbonate, polyphenylene oxide, poly amide, phenol, polyester, polyurethane and styrene resins are more preferred. Acrylic resins or phenol resins are particularly preferred.

The conductive fine particles may preferably be used in an amount of from 3 to 20 parts by weight based on 10 parts by weight of the resin component.

In the case when fine carbon particles and graphite particles are used in combination, the fine carbon particles may preferably be used in an amount of 1 to 50 parts by weight based on 10 parts by weight of the graphite particles.

The resin coat layer in which the conductive fine particles are dispersed may preferably have a volume resistivity of from $10^{-6}$ to $10^{6}$ Ω·cm.

A magenta developing assembly 4-2, a yellow developing assembly 4-3 and a black developing assembly 4-4 are also developing assemblies of non-magnetic one-component developing systems, having the same construction as the yellow developing assembly 4-1.

Only the black developing assembly may be a developing assembly of a magnetic one-component developing system employing an insulating magnetic toner, as occasion calls.

The intermediate transfer member 5 is rotatingly driven in the direction of the arrow at the same peripheral speed as the photosensitive member l.

The first-color cyan toner image formed and borne on the photosensitive member 1 is, in the course where it is passed through the nip portion between the photosensitive member 1 and the intermediate transfer member 5, intermediately transferred to the periphery of the intermediate transfer member 5 by the aid of the electric filed and pressure formed by a primary transfer bias 6 applied to the intermediate transfer member 5. This step is hereinafter called primary transfer. The intermediate transfer member 5 may be either in the form of a drum or in the form of an endless belt.

Subsequently, the second-color magenta toner image, third-color yellow toner image and fourth-color black toner image are successively superimposingly transferred to the surface of the intermediate transfer member 5, so that a synthesized color toner image corresponding to the intended color image is formed.

Reference numeral 10 denotes a transfer belt, which is axially supported in parallel to the rotating shaft of the intermediate transfer member 5 and is provided in contact with the underside thereof. The transfer belt 10 is supported by a bias roller 11 and a tension roller 12, and a desired secondary transfer bias is applied to the bias roller 11 through a secondary bias source 23. The tension roller 12 is grounded.

The primary transfer bias for successively superimposingly transferring the first- to fourth-color toner images from the photosensitive member 1 to the intermediate transfer member 5 is applied from the bias source 6 in the polarity reverse to that of the toners.

In the course of successively superimposingly transferring the first- to fourth-color toner images from the photosensitive member 1 to the intermediate transfer member 5, the transfer belt 10 and an intermediate transfer member cleaning roller 7 are set separable from the intermediate transfer member 5.

To transfer to a transfer medium P the synthesized color toner image formed by superimposing transfer onto the intermediate transfer member 5, the transfer belt 10 is brought into contact with the intermediate transfer member 5 and at the same time the transfer medium P is fed from a paper feed cassette (not shown) through resist rollers 13 and a pre-transfer guide 24 to the contact nip between the intermediate transfer member 5 and the transfer belt 10 at a given timing. The secondary bias is simultaneously applied from the bias source 23 to a bias roller 11. As a result of the application of this secondary bias, the synthesized color toner image is transferred from the intermediate transfer member 5 to the transfer medium P. This step is hereinafter called secondary transfer. The secondary transfer may alternatively be carried out using a transfer roller to which a bias is applied.

The transfer medium P to which the full-color toner image has been transferred is guided into a pressure-and-heat fixing assembly 25 having a heating roller 14 and a pressure roller 15, and heated and fixed there. When the toner of the present invention is used, the toner image can be fixed without causing offset even if an offset preventive agent such as silicone oil is not applied to the heating roller 14.

The intermediate transfer member 5 is comprised of a pipe-like conductive mandrel 5*b* and a medium-resistance elastic material layer 5*a* formed on its periphery. The mandrel 5*b* may comprise a plastic pipe provided thereon with a conductive coating.

The medium-resistance elastic material layer 5*a* is a solid or foamed-material layer made of an elastic material such as silicone rubber, Teflon rubber, chloroprene rubber, urethane rubber or EPDM (an ethylene-propylene-diene terpolymer) in which a conductivity-providing agent such as carbon black, zinc oxide, tin oxide or silicon carbide has been mixed and dispersed to adjust electrical resistance (volume resistivity) to a medium resistance of from $10^5$ to $10^{11}$ Ω·cm.

If necessary, after the toner image has been transferred to the transfer medium, the surface of the intermediate transfer member 5 is cleaned by a detachable cleaning means. When the toner is present on intermediate transfer member 5, the cleaning means is separated from the surface of the intermediate transfer member so that the toner image is not disturbed.

For example, the intermediate transfer member 5 is cleaned simultaneously with the primary transfer from the photosensitive member 1 to the intermediate transfer member 5, by reverse-transferring the toner remaining after the secondary transfer on the intermediate transfer member 5, to return it to the photosensitive member 1, and collecting it by means of a cleaner 9 for the photosensitive member 1.

Its mechanism will be described. The toner image formed on the intermediate transfer member 5 is transferred to the transfer medium P fed onto the transfer belt 10, by the aid of the strong electric field formed upon application of the secondary transfer bias to the bias roller 11, the secondary transfer bias having a polarity reverse to that of the charge polarity (negative polarity) of this toner image.

At this stage, most of the toner remaining on the intermediate transfer member 5 after the secondary transfer without being transferred to the transfer medium P is charged to a polarity (positive polarity) reverse to the normal charge polarity (negative polarity).

However, it does not mean that the secondary transfer residual toner is reversed to the positive polarity in its entirety. Toner having been neutralized to have no electric charges and toner retaining the negative polarity are also present in part.

A charging means 7 by which even the toner having been partly neutralized to have no electric charges and the toner retaining the negative polarity are turned to have the reverse polarity is provided after the position of secondary transfer and before the position of primary transfer.

As the result, almost all the secondary transfer residual toner can be returned to the photosensitive member 1.

When the reverse transfer of the secondary transfer residual toner to the photosensitive member 1 is carried out simultaneously with the primary transfer of the toner image formed on the photosensitive member 1 to the intermediate transfer member 5, the secondary transfer residual toner charged to the reverse polarity on the intermediate transfer member 5 and the normal toner participating in the primary transfer are almost not electrically neutralized at the nip portion between the photosensitive member 1 and the intermediate transfer member 5, so that the toner reversely charged and the toner normally charged are transferred to the photosensitive member 1 and the intermediate transfer member 5, respectively.

This is because the electric field applied across the photosensitive member 1 and the intermediate transfer member 5 at the primary transfer nip is weakened by making the primary transfer bias lower to prohibit the discharging at the nip portion so that the polarity of toner at the nip portion can be prevented from being changed.

Moreover, since the triboelectrically chargeable toner has electrically insulating properties, the toners having the polarities reverse to each other do not cancel their electrical charges in a short time, so that the polarities are neither reversed nor neutralized.

Thus, the secondary transfer residual toner charged to the positive polarity on the intermediate transfer member 5 is transferred to the photosensitive member 1, and the toner image charged to the negative polarity on the photosensitive member 1 is transferred to the intermediate transfer member 5, showing behavior independent from each other.

When the image is formed on one sheet of transfer medium P in accordance with one-time signals for the start of image formation, the toner remaining after the secondary transfer on the intermediate transfer member 5 is reverse-transferred to the photosensitive member 1 without transferring the toner image from the photosensitive member 1 to the intermediate transfer member 5 after the secondary transfer.

In the present example, as a charging means for charging the secondary transfer residual toner on the intermediate transfer member 5, a contact type charging means, specifically stated, an elastic roller having a plurality of layers is used as a cleaning roller for the intermediate transfer member.

The present invention will be described below in greater detail by giving Examples.

POLYESTER RESIN SYNTHESIS EXAMPLE 1

| | |
|---|---|
| Isophthalic acid | 48 mol % |
| Etherified bisphenol A represented by the following formula | 52 mol % |

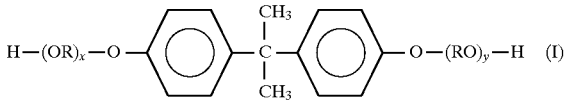

(I)

(wherein R represents a propylene group, and x+y is about 2).

The above dicarboxylic acid and diol and a catalytic amount of dibutyltin oxide were added into a four-necked flask equipped with a thermometer, a stirrer, a reflux condenser and a nitrogen gas feeding pipe. The flask was gradually heated while passing nitrogen gas into the flask, and the temperature was raised to 150° C. to carry out condensation reaction between the dicarboxylic acid and the diol. At the latter half of the condensation reaction, the temperature was raised to 200° C. to proceed the condensation reaction under reduced pressure to prepare polyester resin No. 1 shown in Table 1.

POLYESTER RESIN SYNTHESIS EXAMPLES 2 TO 7

The procedure of Synthesis Example 1 was repeated but appropriately changing synthesis conditions and monomers, to prepare polyester resins Nos. 2 to 7 shown in Table 1.

COMPARATIVE POLYESTER RESIN SYNTHESIS EXAMPLES 1 TO 5

The procedure of Synthesis Example 1 was repeated to prepare comparative polyester resins Nos. 1 to 5 shown in Table 1.

exchanged water and 450 parts by weight of an aqueous 0.1 mol/liter $Na_3PO_4$ solution were introduced, and the mixture was heated to 65° C. with stirring at 12,000 rpm. Then, 68 parts by weight of an aqueous 1.0 mol/liter $CaCl_2$ solution was added thereto little by little to prepare an aqueous dispersion medium of pH 9 containing fine-particle hardly water-soluble dispersion stabilizer $Ca_3(PO_4)_2$.

Next, following materials:

| | |
|---|---|
| Styrene monomer | 175 parts |
| n-Butyl acrylate monomer | 25 parts |
| Cyan colorant (phthalocyanine pigment, C.I. Pigment Blue 15:3) | 15 parts |
| Polar resin (polyester resin No. 1) | 20 parts |
| Negative charge control agent (aluminum compound of di-t-butylsalicylic acid) | 2 parts |
| Release agent (ester wax No. 1; DSC main peak: 73° C.; half width; 3° C.) | 40 parts |
| Cross-linking agent (divinylbenzene) | 0.2 part (all by weight) |

were dispersed for 3 hours by means of an attritor, and thereafter 4 parts by weight of a polymerization initiator 2,2'-azobis(2,4-dimethylvaleronitrile) was added to obtain a dispersion. The dispersion was then introduced to the above aqueous dispersion medium to carry out granulation for 12 minutes at number of revolution of 12,000 rpm. Thereafter, the high-speed stirrer was replaced with a stirrer having propeller stirring blades, and the suspension polymerization was continued for 5 hours at an internal temperature of 65° C. and at 50 rpm. Thereafter, 2 parts by weight of potassium persulfate was added to modify the surfaces of polymer particles, and then the temperature was raised to 85° C., which was maintained for 5 hours.

After the suspension polymerization was completed, the slurry was cooled, and diluted hydrochloric acid was added to dissolve the calcium phosphate.

After the toner particles were separated by filtration, these were further washed and then dried to obtain cyan toner

TABLE 1

| Polyester resin | Dicarboxylic acid | Diol | THF-soluble matter $Mw_2$ | $Mn_2$ | $Mw_2/Mn_2$ | Content (wt. %) | Ethyl alcohol-soluble matter $Mw_3$ | $Mn_3$ | Content (wt. %) | $Mw_2/Mw_3$ | Acid value (mgKOH/g) | Tg (°C.) |
|---|---|---|---|---|---|---|---|---|---|---|---|---|
| No. 1 | IPA | BPD | 11,000 | 5,200 | 2.1 | 100 | 2,000 | 1,100 | 5.0 | 5.5 | 10 | 70 |
| No. 2 | IPA | BPD | 9,000 | 4,100 | 2.2 | 100 | 1,500 | 600 | 6.0 | 6.0 | 20 | 80 |
| No. 3 | IPA + TPA | BPD | 45,000 | 14,000 | 3.2 | 100 | 6,200 | 2,000 | 3.0 | 7.3 | 5 | 65 |
| No. 4 | IPA + TPA | BPD | 16,000 | 6,400 | 2.5 | 100 | 4,000 | 1,800 | 7.0 | 4.0 | 30 | 60 |
| No. 5 | IPA | BPD | 21,000 | 8,000 | 2.6 | 100 | 2,300 | 1,000 | 2.0 | 9.1 | 15 | 70 |
| No. 6 | TPA | BPD | 18,000 | 9,000 | 2.0 | 100 | 5,400 | 1,700 | 0.8 | 3.3 | 2 | 95 |
| No. 7 | TPA | BPD | 7,500 | 3,300 | 2.3 | 100 | 1,000 | 550 | 13.0 | 7.5 | 37 | 50 |
| Comparative: | | | | | | | | | | | | |
| No. 1 | TPA + FMA | BPD | 61,000 | 15,000 | 4.1 | 95 | 4,800 | 2,000 | 0.05 | 12.7 | 10 | 70 |
| No. 2 | TPA | BPD | 5,500 | 2,300 | 2.4 | 100 | 900 | 500 | 25.0 | 6.1 | 43 | 70 |
| No. 3 | TPA + MLA | BPD | 58,000 | 20,000 | 2.9 | 90 | 8,500 | 3,300 | 0.08 | 6.8 | 1 | 65 |
| No. 4 | TPA | BPD | 3,400 | 1,900 | 1.8 | 100 | 800 | 500 | 34.0 | 4.3 | 50 | 55 |
| No. 5 | TPA | BPD | 6,000 | 1,800 | 3.3 | 40 | 500 | 300 | 0.02 | 12.0 | 5 | 70 |

IPA: Isophthalic acid; TPA: Terephthalic acid; FMA: Fumaric acid; MLA: Maleic acid BPD: Bisphenol derivative
Remarks: Polyester resin No. 3: Cross-linked polyester resin having trimethylol propane added as alcohol component. Comparative polyester resin No. 5: Cross-linked polyester resin having trimellitic anhydride added as acid component.

EXAMPLE 1

Into a four-necked flask equipped with a high-speed stirrer TK-type homomixer, 910 parts by weight of ionparticles having a weight average particle diameter of 6 μm and a coefficient of number variation of 27%.

By mixing 100 parts by weight of the cyan toner particles thus obtained and 2 parts by weight of fine titanium oxide particles having been subjected to hydrophobic treatment, a cyan toner No.1 having good fluidity. It contained the phthalocyanine pigment in an amount of 7.5 parts by weight, the polyester resin 10 parts by weight, the aluminum compound 1 part by weight and the ester wax 20 parts by weight, based on 100 parts by weight of the styrene/n-butyl acrylate copolymer formed from the styrene monomer and the n-butyl acrylate monomer.

Cross sections of the toner particles were microscopically observed to confirm that the ester wax was well encapsulated with the styrene/n-butyl acrylate copolymer and polyester resin. Since the ethyl alcohol-soluble matter of the polyester resin No. 1 was well extracted from the cyan toner particles by merely putting the cyan toner particles in ethyl alcohol, and the styrene/n-butyl acrylate copolymer does not substantially dissolve in ethyl alcohol, it was confirmed that the polyester resin was well localizing on the outermost surfaces of the cyan toner particles.

Physical properties of the cyan toner No. 1 are shown in Table 2.

The cyan toner No. 1 was put into the developing assembly 4-1, the process unit as shown in FIG. 5, which was then set on the image forming apparatus shown in FIG. 4, and image reproduction in a monochromatic mode was tested in an environment of normal temperature/normal humidity (23° C./60% RH). The obtained fixed cyan-color images were good and fog-free with a high image density even in a 6,000 sheet multiple-sheet running test. Even after the 6,000 sheet running test, no melt adhesion of the toner was seen on the toner coating roller 18, the developing sleeve 16 or the elastic blade. Also, no offset phenomenon occurred with oil-less fixing, i.e. when fixation was carried out without application of dimethylsilicone oil on the fixing roller 14.

The quantity of triboelectricity of the cyan toner No. 1 on the developing sleeve 16 was also measured to reveal that it was as high as −54 mC/kg, and the quantity of triboelectricity of the cyan toner No. 1 less fluctuated during the running, and was kept stable.

Image reproduction was also tested in an environment of high temperature/high humidity (30° C./80% RH) and an environment of low temperature/low humidity (15° C./10% RH). As a result, good results were obtained.

Results of evaluation are shown in Tables 3-1 to 3-3.

The evaluation was made on the following.

Image density

Image densities at solid image areas are measured using Mcbeth Reflection Densitometer (manufactured by Mcbeth Co.). Here, densities at areas having a glossiness of 25 to 35 as measured with a gloss meter (PG-3D, manufactured by Nippon Hasshoku Kogyo K.K.) are measured.

Fogging

Fogging is evaluated by measuring it using REFLECTOMETER MODEL TC-6DS (manufactured by Tokyo Denshoku Co., Ltd.). For the measurement of cyan toner images, the amber filter is used. Fogging is calculated according to the following expression. The smaller the value is, the less fogging is.

Fogging (reflectance %)=[Reflectance (%) of standard paper]−[Reflectance (%) of non-image area of sample]

Fixing Start Temperature and High-temperature Offset-free Temperature

Temperature of the heating roller 14 and pressure roller 15 having fluorine resin surface layers, of the heat-and-pressure fixing assembly are set in a range of 100° C. to 200° C. at intervals of 5° C., and fixing is performed at each temperature. Fixed images obtained are rubbed with Silbon paper under application of a load of 50 g/cm$^2$, and the temperature at which the reduction% of the image density after the rubbing is less than 10 % is regarded as the fixing start temperature.

The maximum temperature at which no offset phenomenon is observed to occur when the fixing temperature is gradually raised, is regarded as high-temperature offset-free temperature.

Evaluation of Developing Assembly During Multiple-sheet Running

When a faulty image ascribable to the developing assembly occurs during the multiple-sheet running, the operation is stopped and the degree of contamination of the toner coating roller surface, developing sleeve surface and elastic blade surface and the state of melt adhesion of toner are visually examined.

When no faulty images occur during the multiple-sheet running, the degree of contamination of the toner coating roller surface, developing sleeve surface and elastic blade surface and the state of melt adhesion of toner are visually examined after the multiple-sheet running test.

A: Substantially no contamination and no melt adhesion of toner was observed.

B: Contamination and melt adhesion of toner are observed, but no conspicuous faulty images occur.

C: Contamination and melt adhesion of toner seriously occur to cause faulty images.

Transparency

Light transmittance of the fixed image formed on an OHP sheet is measured with respect to the quantity of each toner per unit area, and the transparency is evaluated using the value at the toner weight per unit area of 0.70 mg/cm$^2$, to evaluate the transparency. The transmittance is measured in the manner shown below.

The transmittance is measured using Shimadzu Automatic Spectrophotometer UV2200 (manufactured by Shimadzu Corporation). Regarding the transmittance of OHP film alone as 100%, transmittance is measured at maximum absorption wavelength of;

magenta toner: 550 nm;

cyan toner: 410 nm; and yellow toner: 650 nm.

EXAMPLES 2 TO 7

Cyan toners Nos. 2 to 7 were produced in the same manner as in Example 1 except that the polyester resins Nos. 2 to 7 were used respectively. Physical properties of the cyan toners Nos. 2 to 7 are shown in Table 2.

Subsequently, using the cyan toners Nos. 2 to 7, evaluation tests were made in the same manner as in Example 1. The results of evaluation are shown in Tables 3-1 to 3-3.

COMPARATIVE EXAMPLES 1 TO 5

Comparative cyan toners Nos. 1 to 5 were produced in the same manner as in Example 1 except that the comparative polyester resins Nos. 1 to 5 were used respectively. Physical properties of the comparative cyan toners Nos. 1 to 5 are shown in Table 2.

Subsequently, using the comparative cyan toners Nos. 1 to 5, evaluation tests were made in the same manner as in Example 1. The results of evaluation are shown in Tables 3-1 to 3-3.

COMPARATIVE EXAMPLES 6 TO 10

Comparative cyan toners Nos. 6 to 10 were produced in the same manner as in Example 1 except that the comparative polyester resins Nos. 1 to 5 were used and the surfaces of cyan toner particles were not treated with potassium persulfate in the aqueous medium. Physical properties of the comparative cyan toners Nos. 6 to 10 are shown in Table 2.

Subsequently, using the comparative cyan toners Nos. 6 to 10, evaluation tests were made in the same manner as in Example 1. The results of evaluation are shown in Tables 3-1 to 3-3.

EXAMPLES 8 TO 13

Cyan toners Nos. 8 to 13 were produced in the same manner as in Example 1 except that release agents Nos. 2 to 7 shown in Table 4 were used respectively. Physical properties of the cyan toners Nos. 8 to 13 are shown in Table 2.

Subsequently, using the cyan toners Nos. 8 to 13, evaluation tests were made in the same manner as in Example 1. The results of evaluation are shown in Tables 3-1 to 3-3.

TABLE 2

| | Polar resin Polyester resin | Weight av. particle diam. (μm) | Number variation coefficient (%) | SF-1 | Binder resin: GPC of THF-soluble matter $Mw_1$ | Binder resin: GPC of THF-soluble matter $Mn_2$ | Tolene insoluble matter (%) | Toner agglomeration deg. (%) | Anti-blocking | Quantity of triboelectricity (mC/kg) N/N | H/H | L/L |
|---|---|---|---|---|---|---|---|---|---|---|---|---|
| Example: | | | | | | | | | | | | |
| 1 | No. 1 | 6.0 | 27 | 108 | 180,000 | 3,000 | 7 | 5 | A | −40 | −35 | −53 |
| 2 | No. 2 | 6.4 | 29 | 110 | 280,000 | 20,000 | 10 | 7 | A | −38 | −36 | −54 |
| 3 | No. 3 | 6.8 | 28 | 104 | 210,000 | 25,000 | 14 | 13 | A | −35 | −28 | −46 |
| 4 | No. 4 | 5.4 | 30 | 112 | 630,000 | 16,000 | 3 | 17 | A | −43 | −25 | −48 |
| 5 | No. 5 | 7.3 | 26 | 120 | 160,000 | 23,000 | 12 | 6 | A | −45 | −32 | −56 |
| 6 | No. 6 | 7.5 | 33 | 118 | 140,000 | 31,000 | 16 | 3 | A | −30 | −22 | −41 |
| 7 | No. 7 | 7.8 | 31 | 127 | 190,000 | 18,000 | 18 | 22 | B | −32 | −24 | −52 |
| 8 | No. 1 | 6.2 | 28 | 106 | 190,000 | 29,000 | 8 | 5 | A | −41 | −34 | −55 |
| 9 | No. 1 | 6.4 | 27 | 105 | 200,000 | 21,000 | 11 | 8 | A | −38 | −31 | −49 |
| 10 | No. 1 | 6.2 | 28 | 108 | 220,000 | 23,000 | 6 | 10 | A | −42 | −33 | −47 |
| 11 | No. 1 | 6.3 | 31 | 103 | 260,000 | 15,000 | 2 | 27 | B | −29 | −20 | −40 |
| 12 | No. 1 | 8.2 | 36 | 128 | 190,000 | 14,000 | 17 | 23 | B | −26 | −21 | −38 |
| 13 | No. 1 | 7.9 | 39 | 127 | 180,000 | 14,500 | 19 | 21 | B | −28 | −24 | −36 |
| Comparative Example: | | | | | | | | | | | | |
| 1 | No. 1 | 8.3 | 37 | 134 | 1,200,000 | 13,000 | 60 | 1 | C | −23 | −14 | −31 |
| 2 | No. 2 | 8.5 | 41 | 136 | 100,000 | 31,000 | 3 | 35 | C | −38 | −18 | −70 |
| 3 | No. 3 | 9.2 | 45 | 138 | 1,160,000 | 19,000 | 51 | 2 | C | −24 | −13 | −31 |
| 4 | No. 4 | 8.7 | 48 | 141 | 200,000 | 21,000 | 6 | 31 | D | −31 | −16 | −75 |
| 5 | No. 5 | 10.3 | 46 | 143 | 180,000 | 16,000 | 21 | 38 | D | −28 | −12 | −40 |
| 6 | No. 1 | 8.3 | 36 | 133 | 1,200,000 | 13,000 | 61 | 1 | C | −18 | −7 | −25 |
| 7 | No. 2 | 8.6 | 43 | 135 | 800,000 | 31,000 | 7 | 36 | C | −19 | −8 | −28 |
| 8 | No. 3 | 9.3 | 44 | 139 | 1,160,000 | 19,000 | 48 | 2 | C | −14 | −9 | −21 |
| 9 | No. 4 | 8.7 | 49 | 140 | 200,000 | 21,000 | 7 | 33 | D | −20 | −5 | −30 |
| 10 | No. 5 | 10.5 | 45 | 142 | 180,000 | 16,000 | 22 | 35 | D | −15 | −6 | −18 |

Remarks: Quantity of triboelectricity: Value after mixing with silicone resin-coated ferrite carrier (average particle diameter: 50 μm)

N/N: Normal temp./normal humidity; H/H: High temp./high humidity; L/L: Low temp./low humidity

TABLE 3-1

In Normal Temperature/Normal Humidity Environment

| | Image density | | Fog | | Quantity of triboelectricity of toner on developing sleeve | | Fixing start temp. | High temp. offset free temp. | Light*1 transmittance | Developing*2 assembly contamination | | |
|---|---|---|---|---|---|---|---|---|---|---|---|---|
| | Initial | 6,000 sheets | Initial | 6,000 sheets | Initial (mC/kg) | 6,000 sheets (mC/kg) | (°C.) | (°C.) | (%) | (1) | (2) | (3) |
| Example: | | | | | | | | | | | | |
| 1 | 1.63 | 1.54 | 0.59 | 0.84 | −54 | −45 | 140 | 210 | 80 | A | A | A |
| 2 | 1.58 | 1.56 | 0.61 | 0.79 | −48 | −43 | 145 | 210 | 75 | A | A | A |
| 3 | 1.53 | 1.52 | 0.31 | 0.66 | −45 | −48 | 140 | 220 | 78 | A | A | A |
| 4 | 1.52 | 1.55 | 0.45 | 0.53 | −47 | −42 | 140 | 210 | 70 | A | A | A |
| 5 | 1.57 | 1.53 | 0.81 | 0.74 | −40 | −42 | 145 | 210 | 72 | A | A | A |
| 6 | 1.45 | 1.43 | 1.35 | 1.04 | −28 | −35 | 150 | 200 | 73 | A | A | B |
| 7 | 1.41 | 1.45 | 1.28 | 1.38 | −24 | −34 | 135 | 210 | 70 | A | B | A |
| 8 | 1.54 | 1.56 | 0.41 | 0.71 | −46 | −51 | 140 | 210 | 73 | A | A | A |
| 9 | 1.55 | 1.51 | 0.78 | 0.65 | −41 | −45 | 140 | 210 | 81 | A | A | A |
| 10 | 1.58 | 1.52 | 0.67 | 0.53 | −52 | −48 | 140 | 210 | 75 | A | A | A |
| 11 | 1.43 | 1.39 | 1.41 | 1.48 | −23 | −31 | 135 | 190 | 58 | B | B | B |
| 12 | 1.45 | 1.41 | 1.55 | 1.66 | −25 | −35 | 160 | 200 | 43 | B | B | B |
| 13 | 1.42 | 1.40 | 1.35 | 1.63 | −26 | −33 | 170 | 200 | 47 | B | B | B |
| Comparative Example: | | | | | | | | | | | | |
| 1 | 1.25 | 1.28 | 2.46 | 2.58 | −18 | −15 | 190 | 220 | 45 | B | C | C |
| 2 | 1.34 | 1.31 | 2.05 | 2.11 | −19 | −9 | 140 | 190 | 70 | C | C | C |
| 3 | 1.23 | 1.25 | 2.58 | 2.64 | −15 | −13 | 190 | 220 | 51 | B | C | C |
| 4 | 1.28 | 1.24 | 2.44 | 2.56 | −18 | −8 | 140 | 210 | 71 | C | C | C |
| 5 | 1.26 | 1.25 | 2.32 | 2.88 | −17 | −7 | 140 | 210 | 73 | C | C | C |
| 6 | 1.14 | 1.11 | 2.58 | 2.91 | −13 | −5 | 190 | 220 | 45 | B | C | C |
| 7 | 1.24 | 1.20 | 2.71 | 2.89 | −10 | −7 | 140 | 190 | 70 | C | C | C |
| 8 | 1.11 | 1.10 | 2.66 | 2.81 | −12 | −4 | 190 | 220 | 51 | B | C | C |
| 9 | 1.19 | 1.15 | 2.58 | 2.79 | −11 | −6 | 140 | 210 | 71 | C | C | C |
| 10 | 1.17 | 1.16 | 2.41 | 2.88 | −9 | −3 | 140 | 210 | 73 | C | C | C |

*1: of fixed image on OHP sheet;
*2: during many-sheet running
(1): Toner coating roller; (2): Developing sleeve; (3): Elastic blade

TABLE 3-2

In High Temperature/High Humidity Environment

| | Image density | | Fog | | Quantity of triboelectricity toner on developing sleeve | |
|---|---|---|---|---|---|---|
| | Initial stage | After 6,000 sheet running | Initial stage | After 6,000 sheet running | Initial stage (mC/kg) | After 6,000 sheet running (mC/kg) |
| Example: | | | | | | |
| 1 | 1.48 | 1.44 | 1.13 | 1.21 | −25 | −28 |
| 2 | 1.43 | 1.46 | 1.21 | 1.31 | −28 | −21 |
| 3 | 1.45 | 1.44 | 1.38 | 1.45 | −25 | −23 |
| 4 | 1.42 | 1.40 | 1.41 | 1.40 | −20 | −20 |
| 5 | 1.47 | 1.44 | 1.51 | 1.61 | −29 | −21 |
| 6 | 1.35 | 1.25 | 1.87 | 1.94 | −18 | −14 |
| 7 | 1.38 | 1.34 | 1.94 | 1.89 | −19 | −16 |
| 8 | 1.41 | 1.41 | 1.22 | 1.31 | −27 | −24 |
| 9 | 1.43 | 1.44 | 1.34 | 1.51 | −29 | −23 |
| 10 | 1.45 | 1.40 | 1.48 | 1.53 | −23 | −22 |
| 11 | 1.32 | 1.21 | 1.87 | 2.05 | −17 | −10 |
| 12 | 1.30 | 1.22 | 1.91 | 2.15 | −19 | −13 |
| 13 | 1.31 | 1.26 | 1.79 | 2.00 | −18 | −12 |
| Comparative Example: | | | | | | |
| 1 | 1.15 | 1.11 | 2.23 | 2.94 | −11 | −10 |

TABLE 3-2-continued

| | In High Temperature/High Humidity Environment | | | | | |
|---|---|---|---|---|---|---|
| | Image density | | Fog | | Quantity of triboelectricity toner on developing sleeve | |
| | Initial stage | After 6,000 sheet running | Initial stage | After 6,000 sheet running | Initial stage (mC/kg) | After 6,000 sheet running (mC/kg) |
| 2 | 1.17 | 1.12 | 2.56 | 2.84 | −13 | −11 |
| 3 | 1.13 | 1.10 | 2.32 | 2.81 | −9 | −8 |
| 4 | 1.16 | 1.12 | 2.41 | 2.73 | −10 | −9 |
| 5 | 1.15 | 1.09 | 2.54 | 2.65 | −9 | −9 |
| 6 | 1.01 | 0.95 | 3.11 | 3.51 | −5 | −5 |
| 7 | 1.09 | 0.99 | 3.24 | 3.68 | −7 | −6 |
| 8 | 1.04 | 0.97 | 3.56 | 3.94 | −6 | −3 |
| 9 | 1.03 | 0.96 | 3.14 | 3.61 | −5 | −4 |
| 10 | 1.05 | 0.90 | 3.81 | 3.97 | −7 | −5 |

TABLE 3-3

| | In Low Temperature/Low Humidity Environment | | | | | |
|---|---|---|---|---|---|---|
| | Image density | | Fog | | Quantity of triboelectricity toner on developing sleeve | |
| | Initial stage | After 6,000 sheet running | Initial stage | After 6,000 sheet running | Initial stage (mC/kg) | After 6,000 sheet running (mC/kg) |
| Example: | | | | | | |
| 1 | 1.51 | 1.49 | 1.31 | 1.29 | −51 | −53 |
| 2 | 1.50 | 1.48 | 1.20 | 1.38 | −49 | −47 |
| 3 | 1.49 | 1.51 | 1.29 | 1.31 | −47 | −55 |
| 4 | 1.42 | 1.45 | 1.38 | 1.48 | −42 | −49 |
| 5 | 1.45 | 1.43 | 1.45 | 1.46 | −41 | −46 |
| 6 | 1.38 | 1.33 | 1.56 | 1.78 | −35 | −38 |
| 7 | 1.33 | 1.25 | 1.63 | 1.89 | −56 | −63 |
| 8 | 1.52 | 1.48 | 1.34 | 1.45 | −46 | −43 |
| 9 | 1.49 | 1.47 | 1.11 | 1.36 | −42 | −40 |
| 10 | 1.50 | 1.46 | 1.27 | 1.41 | −45 | −41 |
| 11 | 1.35 | 1.24 | 1.81 | 1.99 | −23 | −30 |
| 12 | 1.33 | 1.25 | 1.79 | 1.87 | −24 | −31 |
| 13 | 1.34 | 1.22 | 1.91 | 2.00 | −22 | −35 |
| Comparative Example: | | | | | | |
| 1 | 1.16 | 1.11 | 2.34 | 2.81 | −23 | −21 |
| 2 | 1.17 | 1.03 | 2.33 | 3.50 | −31 | −102 |
| 3 | 1.16 | 1.15 | 2.45 | 2.91 | −24 | −28 |
| 4 | 1.13 | 1.01 | 2.24 | 3.60 | −33 | −112 |
| 5 | 1.14 | 1.13 | 2.51 | 2.94 | −25 | −21 |
| 6 | 1.05 | 1.01 | 3.21 | 3.41 | −19 | −15 |
| 7 | 1.07 | 0.91 | 3.44 | 3.94 | −25 | −70 |
| 8 | 1.09 | 1.02 | 3.32 | 3.81 | −17 | −12 |
| 9 | 1.08 | 0.90 | 3.51 | 4.00 | −23 | −83 |
| 10 | 1.03 | 0.99 | 3.61 | 3.67 | −16 | −14 |

TABLE 4

| Release agent | Composition | Weight average molecular weight (Mw) | Number average molecular weight (Mn) | Melting point (°C.) | Half width of DSC main peak (°C.) | Viscosity (cPs) | SP value |
|---|---|---|---|---|---|---|---|
| No. 1 | Ester wax | 650 | 540 | 73 | 3 | 3.8 | 8.6 |
| No. 2 | Ester wax | 850 | 710 | 80 | 5 | 5.0 | 8.8 |
| No. 3 | Ester wax | 690 | 580 | 75 | 4 | 3.6 | 8.8 |
| No. 4 | Ester wax | 830 | 700 | 70 | 5 | 3.7 | 9.1 |
| No. 5 | Paraffin wax | 800 | 500 | 70 | 12 | 5.6 | 8.3 |

TABLE 4-continued

| Release agent | Composition | Weight average molecular weight (Mw) | Number average molecular weight (Mn) | Melting point (°C.) | Half width of DSC main peak (°C.) | Viscosity (cPs) | SP value |
|---|---|---|---|---|---|---|---|
| No. 6 | Polyethylene wax | 6,000 | 1,200 | 125 | 25 | 50.0 | 8.4 |
| No. 7 | Polypropylene wax | 14,000 | 4,600 | 139 | 30 | 560.0 | 8.4 |

EXAMPLES 14 TO 16

A magenta toner, a yellow toner and a black toner were produced in the same manner as in Example 1 except that a magenta colorant (C.I. Pigment Red 202), a yellow colorant (C.I. Pigment Yellow 17) and a black colorant (graft carbon black) were used as the colorant respectively. Physical properties of the respective color toners are shown in Table 5.

The cyan toner No. 1 and the above magenta toner, yellow toner and black toner were put into the developing assemblies 4-1, 4-2, 4-3 and 4-4, respectively, and image reproduction in a full-color mode was tested in the environment of normal temperature/normal humidity, using the image forming apparatus shown in FIG. 4. As a result, good full-color fixed images were obtained, which were as good as original images Good results were also obtained in the environment of low temperature/low humidity and in the environment of high temperature/high humidity.

TABLE 5

| Toner | Weight average particle diam. (μm) | Number variation coefficient (%) | SF-1 | Binder resin: GPC of THF-soluble matter $Mw_1$ | Binder resin: GPC of THF-soluble matter $Mn_2$ | Toluene in = soluble matter (wt. %) | (1) (%) | Anti-blocking | Quantity of triboelectricity No. 1 N/N (mC/kg) | No. 1 H/H (mC/kg) | No. 1 L/L (mC/kg) | No. 2 N/N (mC/kg) | No. 2 H/H (mC/kg) | No. 2 L/L (mC/kg) |
|---|---|---|---|---|---|---|---|---|---|---|---|---|---|---|
| Magenta | 6.2 | 27 | 107 | $19 \times 10^4$ | 30,500 | 7 | 4 | A | −41 | −33 | −50 | −43 | −27 | −49 |
| Yellow | 6.5 | 29 | 110 | $18 \times 10^4$ | 29,000 | 8 | 5 | A | −45 | −37 | −56 | −48 | −28 | −51 |
| Black | 6.1 | 26 | 103 | $17 \times 10^4$ | 31,000 | 6 | 6 | A | −38 | −30 | −45 | −39 | −23 | −42 |

(1): Degree of agglomeration of toner
N/N: Normal temp./normal humidity; H/H: High temp./high humidity; L/L: Low temp./low humidity
Remarks: Quantity of triboelectricity No. 1: Value after mixing with silicone resin–coated ferrite carrier (average particle diameter: 50 μm)
Quantity of triboelectricity No. 2: Quantity of triboelectricity of toner on developing sleeve

What is claimed is:

1. A process for producing a toner, comprising the steps of;

preparing a polymerizable monomer composition containing at least styrene monomer-containing polymerizable monomers, a colorant, a polyester resin, a release agent and a polymerization initiator; said polyester resin containing a tetrahydrofuran-soluble matter having a weight average molecular weight $Mw_2$ of from 7,000 to 50,000 and an ethyl alcohol-soluble matter having a weight average molecular weight $Mw_3$ of from 1,000 to 7,000; $Mw_2/Mw_3$ being from 1.2 to 10;

dispersing said polymerizable monomer composition in an aqueous medium to form granules of the polymerizable monomer composition;

causing the localization of polyester resin on the surfaces of the particles of the polymerizable monomer composition;

polymerizing the polymerizable monomers present in the granules to produce a binder resin to form toner particles; said binder resin being a styrene polymer, a styrene copolymer, or a mixture of these, and having a weight average molecular weight $Mw_1$ of from 10,000 to 1,000,000; and adding a water-soluble polymerization initiator in the aqueous medium to treat the surfaces of the toner particles.

2. The process according to claim 1, wherein said water-soluble polymerization initiator is a persulfate.

3. The process according to claim 2, wherein said persulfate is potassium persulfate or ammonium persulfate.

4. The process according to claim 1, wherein said water-soluble polymerization initiator is added in the aqueous medium in an amount of from 0.01 part by weight to 5 parts by weight based on 100 parts by weight of the toner particles.

5. The process according to claim 4, wherein said toner particles are dispersed in said aqueous medium in an amount of from 300 parts by weight to 3,000 parts by weight based on 100 parts by weight.

6. The process according to claim 4, wherein said aqueous medium is heated to 50° C. to 90° C.

7. The process according to claim 4, wherein said toner particles are surface-treated with said water-soluble polymerization initiator in said aqueous medium for 60 minutes to 600 minutes.

8. The process according to claim 1, wherein said aqueous medium has a pH of from 6.8 to 11.

9. The process according to claim 1, wherein said polyester resin is contained in an amount of from 2 parts by weight to 30 parts by weight based on 100 parts by weight of the binder resin, and contains the ethyl alcohol-soluble matter in an amount of from 0.1% by weight to 20% by weight.

10. The process according to claim 1 or 9, wherein said polyester resin has an acid value of 3 mgKOH/g to 35 mgKOH/g.

11. The process according to claim 9, wherein said polyester resin is a resin formed from a material composition containing at least an aromatic dicarboxylic acid and a bisphenol type diol.

12. The process according to claim 1, wherein said binder resin has a weight average molecular weight $Mw_1$ of from 50,000 to 900,000, said polyester resin has $Mw_2$ of from 8,000 to 40,000 and $Mw_3$ of from 1000 to 5,000.

13. The process according to claim 1, wherein said polymerizable monomers contain a styrene monomer and an acrylate monomer.

14. The process according to claim 1, wherein said polymerizable monomers contain a styrene monomer, an acrylate monomer and divinyl benzene.

15. The process according to claim 1, wherein said binder resin contains a toluene-insoluble matter.

16. The process according to claim 1, wherein said polymerizable monomers contain a styrene monomer and a methacrylate monomer.

17. The process according to claim 1, wherein said polymerizable monomers contain a styrene monomer, a methacrylate monomer and divinyl benzene.

18. The process according to claim 1, wherein said release agent is contained in an amount of from 5 parts by weight to 40 parts by weight based on 100 parts by weight of the binder resin.

19. The process according to claim 1, wherein said release agent is contained in an amount of from 12 parts by weight to 35 parts by weight based on 100 parts by weight of the binder resin.

20. The process according to claim 1, wherein said release agent is contained in said toner particles in an amount of from 10% by weight to 30% by weight.

21. The process according to claim 1, wherein said toner particles have a shape factor SF-1 of from 100 to 150.

22. The process according to claim 1, wherein said toner particles have a shape factor SF-1 of from 100 to 125.

23. The process according to claim 1, wherein said toner particles have a weight average particle diameter of from 3 $\mu$m to 8 $\mu$m, and a coefficient of number variation of 35% or less.

24. The process according to claim 1, wherein said release agent is a solid wax.

25. The process according to claim 24, wherein said release agent has a weight average molecular weight of from 300 to 1,500, has a ratio of weight average molecular weight Mw to number average molecular weight Mn, Mw/Mn, of 1.5 or less, has a main endothermic peak in the DSC endothermic curve at a temperature of from 55° C. to 120° C., with a tangent takeoff temperature at 40° C. or above.

26. The process according to claim 25, wherein said release agent has the main endothermic peak in the DSC endothermic curve at a temperature of from 60° C. to 90° C., and the peak has a half width of 10° C. or less.

27. The process according to claim 26, wherein said release agent has the main endothermic peak having the half width of 5° C. or less.

28. The process according to claim 25, wherein said release agent is a solid ester wax.

29. The process according to claim 1, wherein said colorant in said polymerizable monomer composition is a cyan colorant.

30. The process according to claim 29, wherein said polymerizable monomer composition contains a negative charge control agent.

31. The process according to claim 1, wherein said colorant in said polymerizable monomer composition is a magenta colorant.

32. The process according to claim 31, wherein said polymerizable monomer composition contains a negative charge control agent.

33. The process according to claim 1, wherein said colorant in said polymerizable monomer composition is a yellow colorant.

34. The process according to claim 33, wherein said polymerizable monomer composition contains a negative charge control agent.

35. The process according to claim 1, wherein said polyester resin has a ratio of weight average molecular weight $Mw_2$ to number average molecular weight $Mn_2$ of said tetrahydrofuran-soluble matter, $Mw_2/Mn_2$, of from 1.2 to 3.0.

36. The process according to claim 35, wherein said polyester resin has the ratio $Mw_2/Mn_1$ of from 1.5 to 3.0.

* * * * *